US008903289B2

(12) United States Patent
Yu et al.

(10) Patent No.: US 8,903,289 B2
(45) Date of Patent: Dec. 2, 2014

(54) BELT MOVING UNIT AND IMAGE FORMING APPARATUS

(75) Inventors: Yimei Yu, Kanagawa (JP); Junji Hanatani, Kanagawa (JP); Takehiro Oishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 195 days.

(21) Appl. No.: 13/604,194

(22) Filed: Sep. 5, 2012

(65) Prior Publication Data

US 2013/0189003 A1 Jul. 25, 2013

(30) Foreign Application Priority Data

Jan. 23, 2012 (JP) ..... 2012-010952

(51) Int. Cl.
*G03G 15/20* (2006.01)
*G03G 15/16* (2006.01)
*B65H 20/08* (2006.01)

(52) U.S. Cl.
CPC ..... *G03G 15/1685* (2013.01); *B65H 20/08* (2013.01)
USPC ..... 399/313; 226/170; 226/171; 226/181; 226/189; 226/190; 226/191; 226/192; 226/193; 271/272; 271/275; 271/314; 198/780; 198/781.01; 198/781.02; 198/832; 198/835; 193/37

(58) Field of Classification Search
CPC .... G03G 15/1685; B65H 20/06; B65H 20/08; B65H 2404/132; B65H 2404/1321; B65H 2404/431
USPC ..... 399/313; 226/170, 171, 181, 189–193; 271/272, 275, 314; 193/37; 198/780, 198/781.01, 781.02, 832, 835
See application file for complete search history.

(56) References Cited

U.S. PATENT DOCUMENTS

| | | | | |
|---|---|---|---|---|
| 3,964,658 | A * | 6/1976 | Edwards | 226/190 |
| 5,659,851 | A * | 8/1997 | Moe et al. | 226/170 |
| 5,706,995 | A * | 1/1998 | Kikuchi et al. | 226/190 |
| 2010/0084805 | A1* | 4/2010 | Wakana | 271/109 |
| 2012/0118186 | A1* | 5/2012 | Nishiyama et al. | 101/248 |

FOREIGN PATENT DOCUMENTS

| | | | |
|---|---|---|---|
| JP | A-10-293477 | | 11/1998 |
| JP | 2003267532 | A * | 9/2003 |
| JP | B2-3509212 | | 3/2004 |
| JP | A-2005-134805 | | 5/2005 |
| JP | A-2005-316249 | | 11/2005 |

* cited by examiner

*Primary Examiner* — Ryan Walsh
(74) *Attorney, Agent, or Firm* — Oliff PLC

(57) ABSTRACT

A belt moving unit includes an endless belt member and plural support rolls supporting the belt member movably and rotating, wherein the support rolls include one or more follower rolls rotating to follow the movement of the belt member and at least one of the follower rolls is used as an inertial roll to which inertia is applied, wherein the inertial roll includes a rotation shaft, a rotational inertial member rotating with the rotation shaft and applying inertia, and a roll body disposed along a peripheral surface of the rotation shaft and including plural roll-divided members, and wherein the plural roll-divided members include a fixed divided member fixed to the rotation shaft and rotating along with the rotation shaft to follow the movement of the belt member and a rotating divided member rotating independently of the rotation of the rotation shaft.

20 Claims, 28 Drawing Sheets

BELT MOVING UNIT AND IMAGE FORMING APPARATUS

CROSS-REFERENCE TO RELATED APPLICATIONS

This application is based on and claims priority under 35 use 119 from Japanese Patent Application No. 2012-010952 filed Jan. 23, 2012.

BACKGROUND

Technical Field

The present invention relates to a belt moving unit and an image forming apparatus employing the belt moving unit.

SUMMARY

According to an aspect of the invention, there is provided a belt moving unit including: an endless belt member; and plural support rolls that support the belt member movably and that is rotatable, wherein the plural support rolls include one or more follower rolls that rotates to follow the movement of the belt member and at least one of the follower rolls is used as an inertial roll to which inertia is applied in a direction in which an amount of inertia increases, wherein the inertial roll includes a rotation shaft that is rotatable, a rotational inertial member that rotates with the rotation shaft and that applies inertia in a direction in which the amount of inertia of the rotation shaft increases, and a roll body that is disposed along a peripheral surface of the rotation shaft and that includes plural roll-divided members formed by dividing the roll body into plural parts in an axis direction of the rotation shaft, and wherein the plural roll-divided members include a fixed divided member that is fixed to the rotation shaft and that rotates along with the rotation shaft to follow the movement of the belt member, and a rotating divided member that is rotatable independently of the rotation of the rotation shaft.

BRIEF DESCRIPTION OF THE DRAWINGS

Exemplary embodiments of the present invention will be described in detail based on the following figures, wherein.

DETAILED DESCRIPTION

Summary of Exemplary Embodiments

Figure 1A:
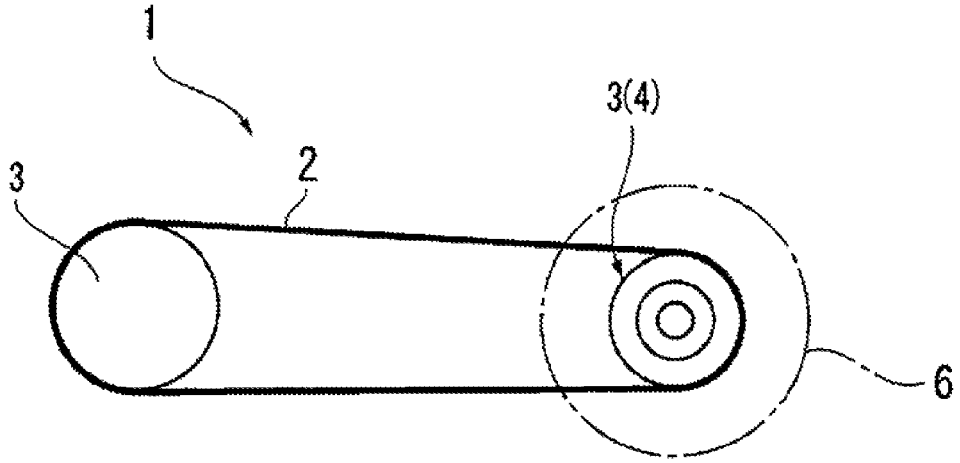
FIG. 1A is a diagram schematically illustrating a belt moving unit according to an exemplary embodiment of the invention and FIG. 1B is a diagram schematically illustrating an inertial roll of FIG. 1A.
Figure 1B:
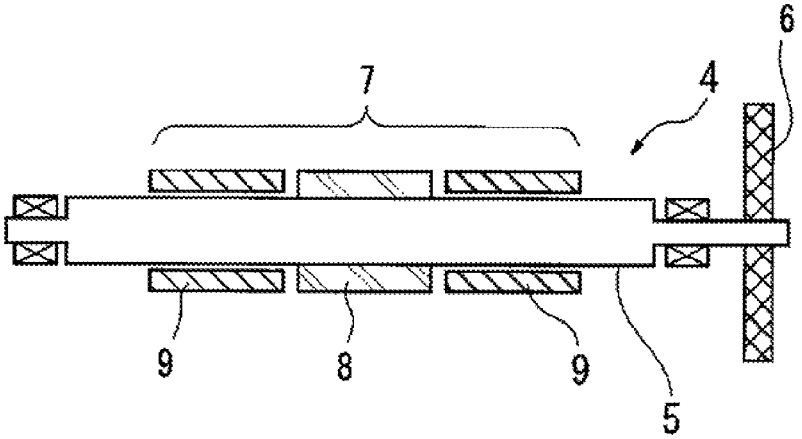

FIG. 1A is a diagram schematically illustrating a belt moving unit 1 according to an exemplary embodiment of the invention and FIG. 1B is a cross-sectional view schematically illustrating an inertial roll.

As shown in FIGS. 1A and 1B, the belt moving unit 1 includes an endless belt member 2 that may move cyclically and plural support rolls 3 that movably support the belt member 2 and that may rotate. The support rolls 3 includes one or more follower rolls rotating to follow the movement of the belt member 2. At least one of the follower rolls is constructed by an inertial roll 4 to which inertia is applied in a direction in which the amount of inertia increases. The inertial roll 4 includes a rotation shaft 5 that may rotate, a rotational inertial member 6 that rotates along with the rotation shaft 5 and that applies inertia in a direction in which the amount of inertia of the rotation shaft 5 increases, and a roll body that is disposed along the peripheral surface of the rotation shaft 5. The roll body includes plural roll-divided members 7 that are arranged by dividing the roll body into plural parts in the axis direction of the rotation shaft 5. The plural roll-divided members 7 include a fixed divided member 8 that is fixed to the rotation shaft 5 and that rotates along with the rotation shaft 5 to follow the movement of the belt member 2 and a rotating divided member 9 that may rotate independently of the rotation of the rotation shaft 5.

The fixed divided member 8 may come in contact with the belt member 2. The rotating divided member 9 may be disposed to be rotatable about the rotation shaft 5 and come in contact with the belt member 2.

Here, the belt member 2 is not particularly limited, and examples thereof include a transfer belt (a secondary transfer belt), an intermediate transfer belt, and a recording medium transporting belt. The material thereof is not particularly limited, and a rubber belt formed of a synthetic rubber or a resin belt formed of a synthetic resin may be used. The number of inertial rolls 4 is not limited to one, but may be two or more.

A representative example of the rotational inertial member 6 is a flywheel. The shape thereof is not particularly limited, and a disc shape or a shape having unevenness on the outer periphery may be used. The rotational inertial member 6 may have a configuration in which viscous fluid or the like is applied to a part thereof. With this configuration, a rotational inertial force may be effectively applied to the inertial roll 4. The rotational inertial member 6 may be directly attached to the rotation shaft 5 or may be attached to the rotation shaft 5, for example, with a gear or the like interposed therebetween. The rotational inertial member 6 has only to rotate along with the rotation shaft 5.

The number of roll-divided members 7 is not particularly limited, as long as they include the fixed divided member 8 and the rotating divided member 9.

The fixed divided member 8 has only to rotate along with the rotation shaft 5, as long as the inertial force of the rotational inertial member 6 may be transmitted to the fixed divided member 8 via the rotation shaft 5. The installation position of the fixed divided member 8 is not particularly limited, as long as it is disposed at a position where meandering or creases of the belt member 2 may be suppressed. On the other hand, the rotating divided member 9 has only to rotate independently of the rotation of the rotation shaft 5, and may be attached to the rotation shaft 5 with bearings interposed therebetween.

By employing this inertial roll 4, the magnitude of a tension acting on the belt member 2 varies at a position at which the fixed divided member 8 comes in contact with the belt member 2 and at a position at which the rotating divided member 9 comes in contact with the belt member 2, between the inertial roll 4 and the belt member 2. That is, the tension is large at the position of the fixed divided member 8 and the tension is small at the position of the rotating divided member 9. Accordingly, a strong force attracting the belt member 2 toward the fixed divided member 8 acts on the belt member 2.

Accordingly, an effect of attracting the belt member 2 to the fixed divided member 8 is exhibited and thus the meandering of the belt member 2 is suppressed. When it is assumed that a crease occurs in the belt member 2, the rotating divided member 9 rotates independently of the rotation of the rotation shaft 5 and thus the crease is dispersed, by the rotating divided member 9, thereby reducing the occurrence of creases. When it is assumed that a variation in load occurs in the belt member 2, the inertial force of the rotational inertial member 6 is transmitted from the rotation shaft 5 to the belt member 2 via the fixed divided member 8, thereby suppressing the variation in velocity in the belt member 2.

In order to further simplify the configuration of the rotating divided member 9, it is preferable that the rotating divided member 9 be fitted to the rotation shaft 5 with a predetermined gap interposed therebetween. Accordingly, the sliding resistance between the rotation shaft 5 and the rotating divided member 9 decreases. From, the viewpoint that the tension of the rotating divided member 9 to the belt member 2 is set to be smaller than the tension of the fixed divided member 8, the outer diameter of the rotating divided member 9 is preferably set to be equal to or less than the outer diameter of the fixed divided member 8.

From the viewpoint of effective transmission of the inertial force of the inertial roll 4 to the belt member 2, the fixed divided member 8 is preferably pressed and fitted to the rotation shaft 5. The fixed divided member 8 may be fixed to the rotation shaft 5 with an adhesive. The rotation shaft 5 includes a large-diameter portion, of which the outer diameter is larger than that of the other part, in a part thereof, and the fixed divided member 8 may be constructed by the large-diameter portion of the rotation shaft 5. Here, when the fixed divided member 8 is constructed by a part of the rotation shaft 5, it is difficult to discretely arrange plural fixed divided members 8 at plural positions and if is thus necessary to consider the arrangement positions.

A convex portion protruding in the diameter direction of the rotation shaft 5 may be formed in one of the fixed divided member 8 and the rotation shaft 5, a concave portion being recessed in the diameter direction of the rotation shaft 5 and having the convex portion inserted therein, and the fixed divided member 8 may be stopped and fixed in the rotation direction, of the rotation shaft 5 by fitting the concave portion and the convex portion with each other when attaching the fixed divided member 8 to the rotation shaft 5. In this case, from the viewpoint of facilitating the attachment of the fixed divided member 8 to the rotation shaft 5, the concave portion and the convex portion are preferably configured so that the convex portion is fitted, into the concave portion with a predetermined gap in the rotation direction of the rotation shaft 5. At this time, the fitting position is not limited, but the fitting position may be the overall length in the axis direction or may be a part thereof.

Examples of such a configuration include a configuration in which the convex portion is formed in the rotation shaft 5 and the concave portion is formed in the fixed divided member 8, a configuration in which the concave portion is formed in the rotation shaft 5 and the convex portion is formed in the fixed divided member 8, and a configuration in which the concave portion and the convex portion are formed in both. By providing a gap in the rotation direction between the concave portion and the convex portion, it is possible to facilitate the attachment of the fixed divided member 8 to the rotation shaft 5. Even when a gap in the rotation direction is provided between the rotation shaft 5 and the fixed divided member 8, the simultaneous rotation of the rotation shaft 5 and the fixed divided member 8 is guaranteed.

From the viewpoint that the tension acting between the fixed divided member 8 and the belt member 2 is set to be greater than the tension acting between the rotating divided member 9 and the belt member 2, the outer diameter of the fixed divided member 8 may be set to be greater than the outer diameter of the rotating divided member 9. In this case, a level difference may be present between the fixed divided member 8 and the rotating divided member 9, but the level difference is preferably small as long as the difference in tension therebetween is guaranteed, from the viewpoint of stabilization of the shape of the belt member 2.

From the viewpoint that the rotating divided member 9 may be made to more freely rotate and the creases of the belt member 2 is suppressed, if is preferable that the rotating divided member 9 be disposed with a predetermined gap from the fixed divided member 8 or the rotating divided member 9 adjacent thereto in the axis direction of the rotation shaft 5 and be movable within the gap. By forming the gap between the rotating divided members 9 or between the rotating divided member 9 and the fixed divided member 8, the movement of the rotating divided member 9 in the axis direction is permitted. Accordingly, when a crease occurs in the belt member 2, the movement easily acts in the direction in which the crease is stretched due to the internal force (the force of the belt member 2 itself) of the belt member 2.

From the viewpoint of suppression of meandering of the belt member 2, it is preferable that the rotating divided member 9 be arranged on both sides of the center of the rotation shaft 5 with the fixed divided member 8 interposed therebetween in the axis direction of the rotation shaft 5. By employing this arrangement, the tension in the vicinity of the center in the width direction crossing the movement direction of the belt member 2 is greater than that in the other part. Accordingly, the belt member 2 moves in a state where it is attracted to the center in the width direction thereof, thereby suppressing the meandering or the occurrence of a crease.

Alternatively, the following configuration may be employed. That is, the fixed divided member 8 may be arranged on both sides of the center of the rotation shaft 5 with the rotating divided member 9 interposed therebetween in the axis direction of the rotation shaft 5. In this case, the tension in the vicinity of the center in the width direction crossing the movement direction of the belt member 2 is smaller than that in the other part. Accordingly, the belt member 2 moves in a state where it is attracted to both ends in the width direction thereof, thereby suppressing the meandering or the occurrence of a crease.

From the viewpoint of effective suppression of meandering of the belt member 2, the fixed divided member 8 and the rotating divided member 9 are preferably arranged to be symmetric about the center of the rotation shaft 5. In this case, the contact states of the belt member 2 and the roll-divided members 7 about the center of the rotation shaft 5 are substantially equivalent to each other.

From the viewpoint that the inertial force of the rotational inertial member 6 is further effectively transmitted between the fixed divided member 8 and the belt member 2, the fixed divided member 8 may have a frictional-resistance layer increasing the fractional resistance with the belt member 2 on the peripheral surface. Regarding this frictional-resistance layer, the surface of the fixed divided member 8 may be roughened, for example, a material having a large difference in the frictional triboelectric series from the belt member 2 may be applied to the surface thereof, or a silicone resin having viscosity may be applied to the surface thereof.

Such a belt moving unit 1 may be applied to an image forming apparatus as follows. That is, the image forming apparatus includes an image holding member holding a toner image and a transfer unit transferring the toner image held on the image holding member to a recording medium, at least one of the image holding member and the transfer unit includes an endless belt member 2 that may move cyclically, and the above-mentioned belt moving unit 1 may be used as a belt moving unit 1 moving the belt member 2. That is, the belt moving unit 1 may be provided to only one of the image holding member and the transfer unit, or may be provided to both thereof.

Figure 2A:
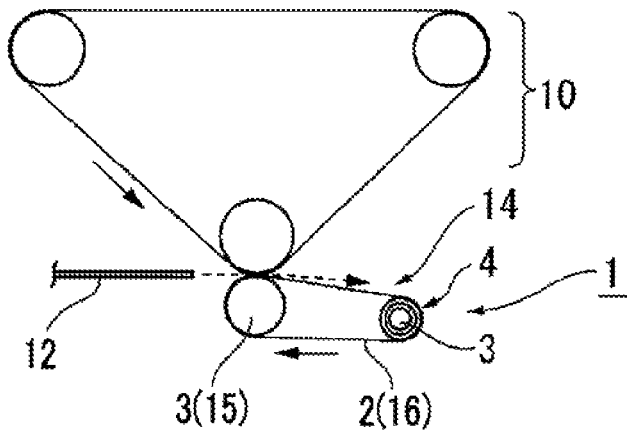
FIGS. 2A, 2B, and 2C are diagrams schematically illustrating various image forming apparatuses employing the inertial roll.
Figure 2B:
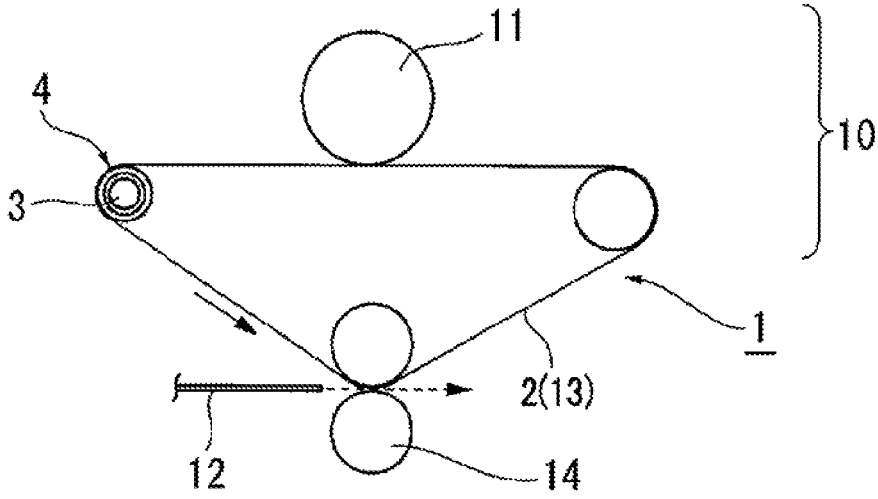
Figure 2C:
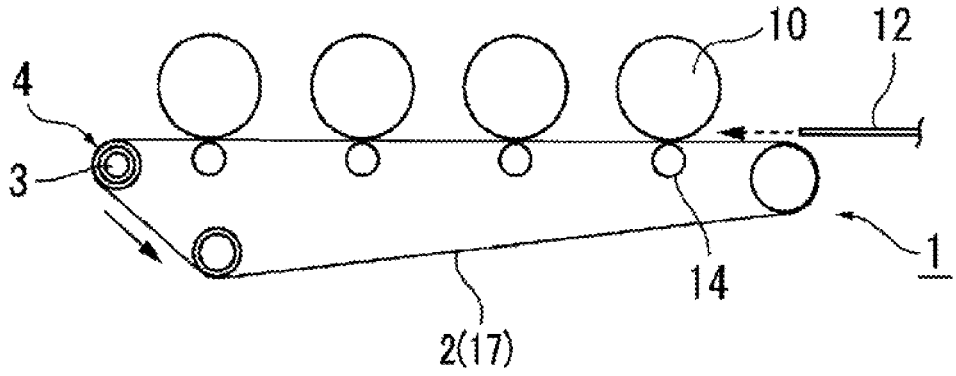

Representative examples of such an image forming apparatus are shown in FIGS. 2A to 2C.

FIG. 2A shows a first example where a transfer unit 14 includes a roll-like transfer member 15 that is disposed to face the image holding member 10 and that transfers a toner image on an image holding member 10 to a recording medium 12 and a transfer belt 16 as the endless belt member 2 that is supported by plural support rolls 3 including the transfer member 15 so as to cyclically move and that transports the recording medium 12 along a linear path extending from a transfer part between the image holding member 10 and the transfer member 15, and the belt moving unit 1 moves the transfer belt 16.

The image holding member 10 in the example may include only a photoreceptor having a toner image formed and held thereon or may include a photoreceptor and an intermediate transfer member (such as an intermediate transfer belt) temporarily holding a toner image from the photoreceptor before the toner image to a recording medium 12. Accordingly, the transfer belt 16 is used in a secondary transfer part in which the toner image primarily transferred to the intermediate transfer member is transferred to the recording medium 12. Examples of the arrangement of the transfer belt 16 include a configuration in which it has a part extending downstream in the transport direction of the recording medium 12 from the secondary transfer part, a configuration in which it has a part extending upstream in the transport direction of the recording medium 12 from the secondary transfer part, and a configuration in which it has a part extending upstream and downstream in the transport direction of the recording medium 12 from the secondary transfer part. In these configurations, the inertial roll 4 is not disposed in the transfer member 15.

In another example of the image forming apparatus, as shown in FIG. 2B, the image holding member 10 includes an image forming and holding member 11 having a toner image formed and held thereon and an intermediate transfer belt 13 as the belt member 2 being disposed to face the image forming and holding member 11 and temporarily nodding the toner image on the image forming and holding member 11 before transferring the toner image to the recording medium 12, and the belt moving unit 1 moves the intermediate transfer belt 13. A representative example of the image forming and holding member 11 is a photoreceptor.

In still another example of the image forming apparatus, as shown in FIG. 2C, the image forming apparatus includes an image holding member 10 holding a toner image, a transfer unit 14 transferring the toner image held on the image holding member 10 to a recording medium 12, and a recording medium transporting unit transporting the recording medium 12 to the opposed part between the image holding member 10 and the transfer unit 14. The recording medium transporting unit includes a recording medium transporting belt 17 as the endless belt member 2 holding and transporting the recording medium 12. The above-mentioned belt moving unit 1 is used as a belt moving unit 1 moving the recording medium transporting belt 17.

The invention will be described below in more detail with reference to the embodiments shown in the accompanying drawings.

First Exemplary Embodiment

Figure 3:
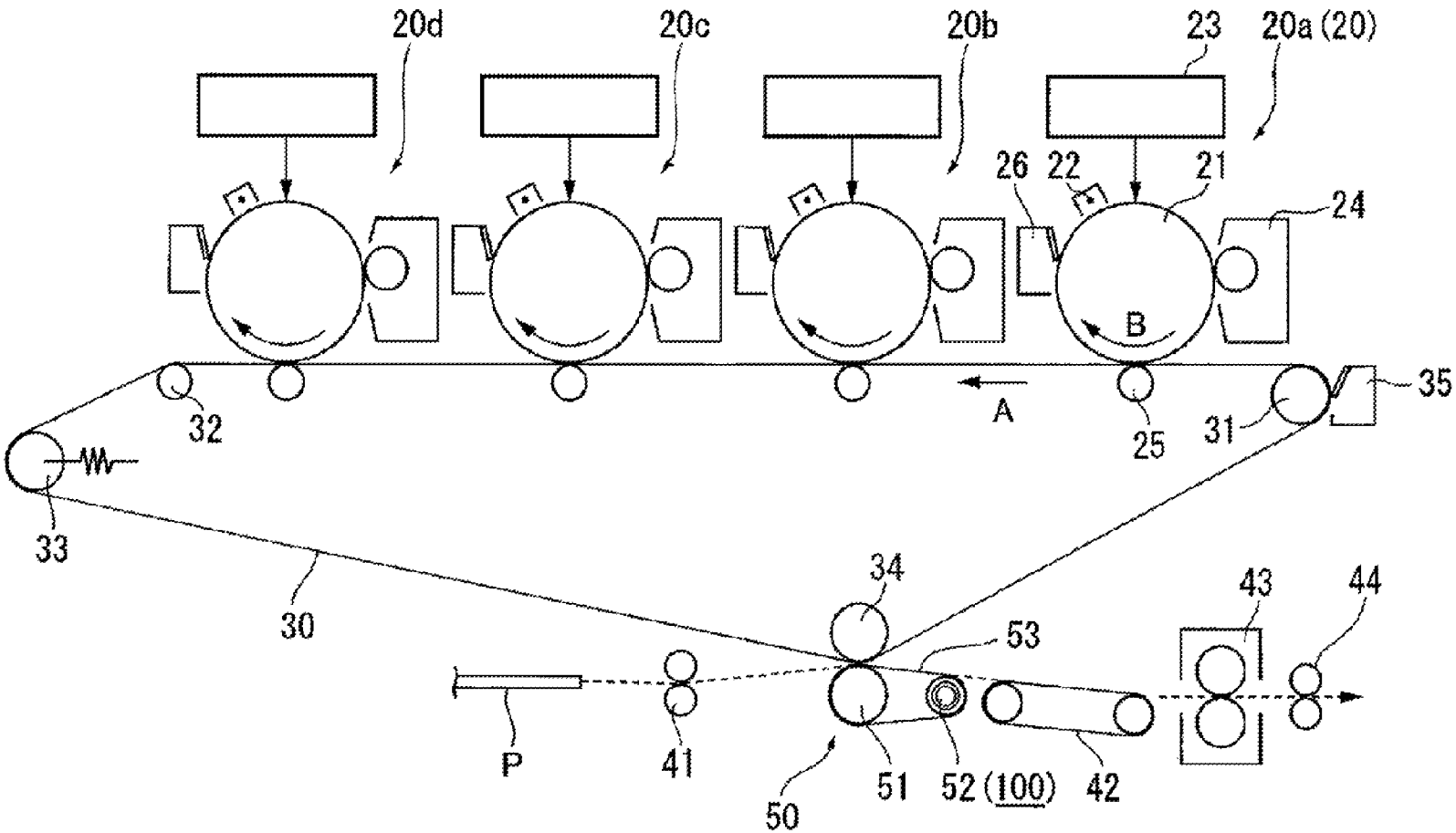
FIG. 3 is a diagram schematically illustrating an image forming apparatus according to a first exemplary embodiment of the invention.

FIG. 3 is a diagram schematically illustrating the configuration of an image forming apparatus according to a first exemplary embodiment employing the belt moving unit of the invention.

Configuration of Image Forming Apparatus

In the drawing, the image forming apparatus according to this exemplary embodiment is, for example, an image forming apparatus employing an electrophotographic system and includes four image forming units 20 (20*a* to 20*d*) linearly arranged as an image forming and holding member having a toner image formed and held thereon, an intermediate transfer belt 30 being disposed to face the image forming units 20 and temporarily holding toner images of the image forming unit 20 before transferring the toner images to a recording medium P, and a transfer device 50 as a transfer unit transferring the toner images temporarily held on the intermediate transfer belt 30 to the recording medium P.

The image forming units 20 (20*a* to 20*d*) form an image, for example, using toners of yellow, magenta, cyan, and black along the movement direction of the intermediate transfer belt 30 indicated by an arrow A in the drawing. The colors or arrangement thereof are not limited to this example, but may be appropriately selected.

Since the image forming units 20 (20*a* to 20*d*) have substantially the same configuration except for the toners to be used, the image forming unit 20*a* (20) disposed on the most upstream side will be described as a representative example.

The image forming unit 20 includes a photoreceptor 21 having a photosensitive layer on the surface thereof and rotating in the direction of arrow B, a charging device 22 charging the photosensitive layer of the photoreceptor 21 to a predetermined potential, an exposing device 23 forming a latent image on the charged photoreceptor 21, a developing device 24 developing the latent image formed on the photoreceptor 21 with the toner to form a toner image, a primary transfer device 25 transferring the developed toner image on the photoreceptor 21 to the intermediate transfer belt 30, and a cleaner 26 cleaning the remaining toner on the photoreceptor 21 after the transfer.

Here, the charging device 22 employs a corona charger type, but may employ a roll-like charger coming in contact with the photoreceptor 21. The exposing device 23 is not particularly limited as long as it may form a latent image on the photoreceptor 21, and a laser scanning type or an LED array type in which LEDs are arranged in a line may be used. The primary transfer device 25 may employ a roll-like type coming in contact with the rear surface of the intermediate transfer belt 30 or a corona charger separated from the intermediate transfer belt 30. A member used for the cleaner 26 may be appropriately selected from a blade, a brush, and the like. For example, a charge remover may be further provided around the photoreceptor 21.

The intermediate transfer belt 30 rotates in a state where it is supported by plural support rolls 31 to 34 and is formed of, for example, a material obtained by adding a conductive filler such as carbon black to a polyimide resin and adjusting the volume resistivity to a predetermined value. Out of the support rolls 31 to 34 supporting the intermediate transfer belt 30, a driving roll 31 rotating the intermediate transfer belt 30 is disposed, upstream from the image forming unit 20*a* on the most upstream side in the rotation direction of the intermediate transfer belt 30, and rotary power from a motor (not shown) is transmitted to the driving roll 31 to rotate the intermediate transfer belt 30. An inertial roll 33 stably maintaining the tension of the rotating intermediate transfer belt 3Q is disposed downstream in the rotation direction of the intermediate transfer belt 30 from the image forming unit 20*d* on the most downstream side and applies a stable tension to the intermediate transfer belt 30 by causing an impelling member such as a spring to project the intermediate transfer belt 30 to the surface side. In the drawing, reference numeral 35 represents a belt cleaner 35 cleaning the intermediate transfer belt 30.

A transfer device (secondary transfer device) 50 is disposed at a position opposed to the support roll 34 with the intermediate transfer belt 30 interposed therebetween and transfers (secondarily transfers) the toner images on the intermediate transfer belt 30 to the recording medium P supplied from a recording medium supply section (not shown) in the secondary transfer part at a time. The transfer device 50 according to this exemplary embodiment includes a support roll 34 as a backup roll, a transfer roll 51 as a transfer member disposed at a position opposed to the backup roll 34 with the intermediate transfer belt 30 interposed therebetween, a support roll (follower roll) 52 having a diameter smaller than that of the transfer roll 51, and a transfer belt 53 being supported between the transfer roll 51 and the follower roll 52 and rotating.

The transfer roll 51 includes a rubber layer, which is adjusted to predetermined volume resistivity, on the surface thereof. The toner image on the intermediate belt 30 is transferred to the recording medium P by applying a transfer electric field between the transfer roll and the backup roll 34 having a rubber layer of which the volume resistivity is adjusted similarly. The transfer belt 53 is formed of, for example, a rubber sheet member having predetermined volume resistivity. By employing this transfer belt 53, the transfer belt 53 rotate to follow the rotation of the intermediate transfer belt 30. The transfer belt 53 is not limited to the rubber belt, but may employ a resin belt formed of, for example, a polymide resin.

A transport system of a recording medium P in the image forming apparatus according to this exemplary embodiment is as follows. A recording medium P transported from a recording medium supply section (not shown) is temporarily positioned by a registration roll (register roll) 41 before reaching the secondary transfer part in which the transfer roll 51 and the support roll 34 face each other, and is then transported to the secondary transfer part at a predetermined time. The recording medium P to which a toner image on the intermediate transfer belt 30 is transferred in the secondary transfer part moves over the transfer belt 53 with the rotation of the transfer belt 53, passes through a fixing device 43 including a heating roll and a pressing roll via a transporting belt 42, and is then discharged from the apparatus by a discharge roll 44.

Figure 4:
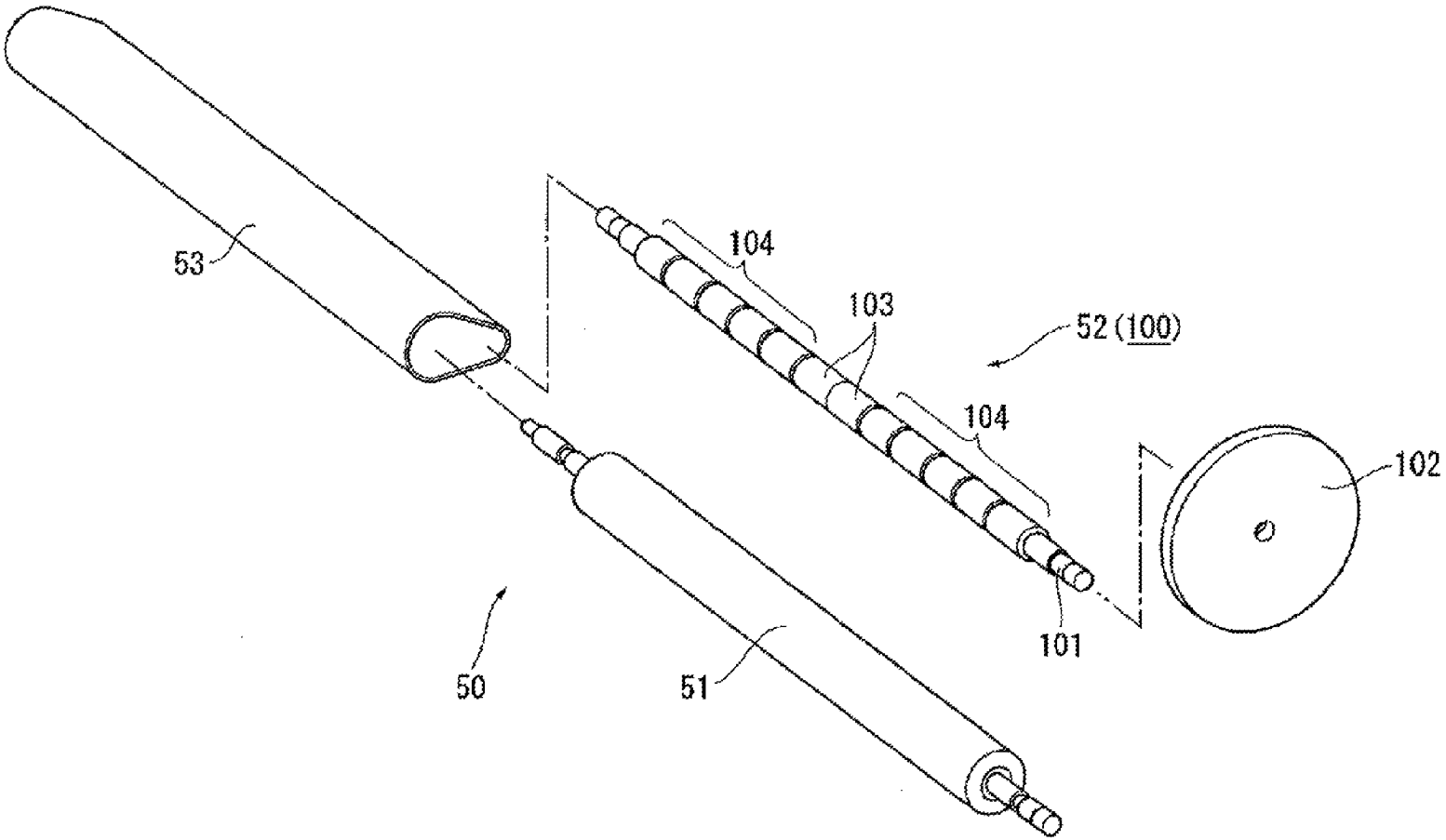
FIG. 4 is a perspective view of a transfer device according to the first exemplary embodiment.

FIG. 4 is a perspective view of the transfer device 50 according to this exemplary embodiment, where the transfer device 50 includes a transfer roll 51 and a follower roll 52 as support rolls supporting the transfer belt 53 inside the transfer belt 53. The follower roll 52 is constructed by the inertial roll 100 to which inertia is applied in a direction in which the amount of inertia increases in this exemplary embodiment.

Configuration of Inertial Roll

The inertial roll 100 includes a rotation shaft 101 that may rotate, a rotational, inertial member (flywheel) 102 rotating along with the rotation shaft 101 and applying the inertia of the rotation shaft 101 in the direction in which the amount of inertia increases, and a roll body disposed along the peripheral surface of the rotation shaft 101. The roll body includes plural roll-divided members arranged in the axis direction of the rotation, shaft 101. The plural roll-divided members include a fixed collar 103 as a fixed divided member that is fixed to the rotation shaft 101, that comes in contact with the transfer belt 53, and that rotates along with the rotation shaft 101 to follow the movement of the transfer belt 53 and a free collar 104 as a rotating divided member that is disposed to be rotatable about the rotation shaft 101, that comes in contact with the transfer belt 53, and that may rotate independently of the rotation of the rotation shaft 101.

Figure 5:
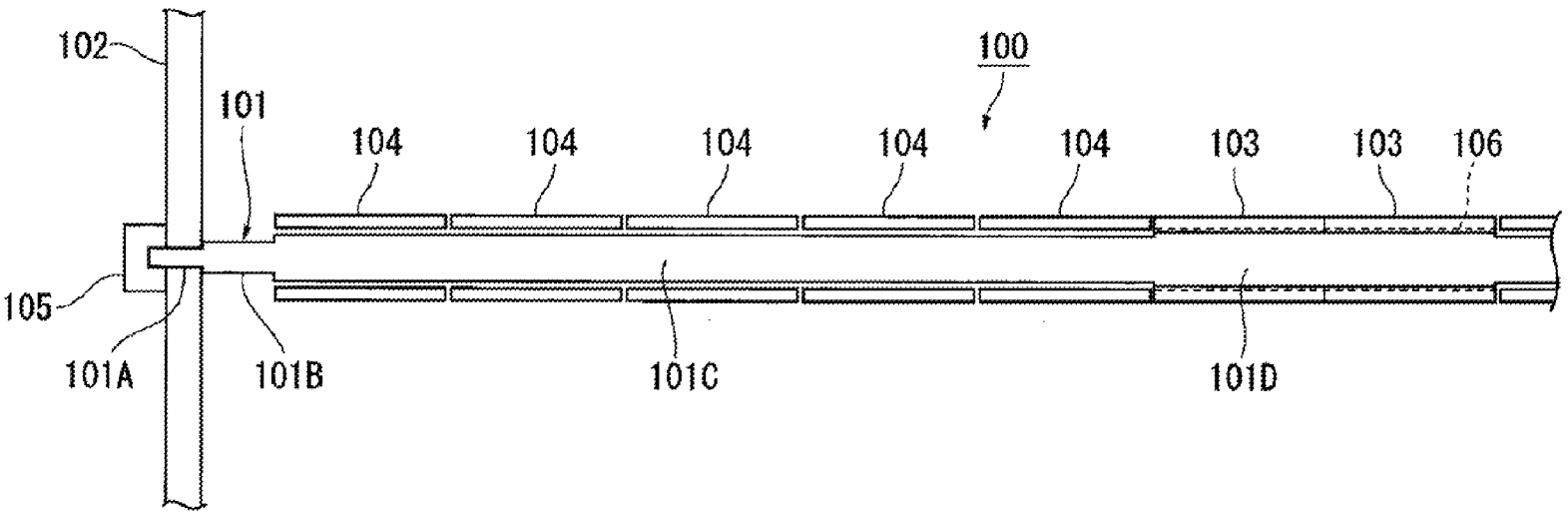
FIG. 5 is a diagram schematically illustrating a partial cross-section of an inertial roll, according to the first exemplary embodiment.

In this exemplary embodiment, the roll-divided members included 12 divided members, two fixed collars 103 are disposed at the center of the rotation shaft 101 and 10 free collars 104 are disposed around the fixed collars 103 at the center. As a result, the fixed collars 103 and the free collars 104 are arranged to be symmetric in the axis direction of the rotation shaft 101. FIG. 5 shows a partial cross-section of the inertial roll 100 according to this exemplary embodiment, where the fixed collars 103 and the free collars 104 are disposed as shown in the drawing.

The rotation shaft 101 in this exemplary embodiment is formed of, for example, a stainless steel alloy and the outer diameter thereof slowly increases from an end to correspond to a small-diameter portion 101A having a small outer diameter, a middle-diameter portion 101B, a large-diameter portion 101C, and a fixed collar portion 101D having an outer diameter slightly larger than that of the large-diameter portion 101C. In the rotation shaft 101, the fixed collars 103 are press-fitted, to the fixed collar portion 101D and the free collars 104 are attached to the large-diameter portion 101C. A flywheel 102 formed of, for example, a stainless steel alloy is attached to the small-diameter portion 101A and is together fixed, with a cap 105 so as to fix the flywheel 102 to the rotation shaft 101. The flywheel 102 can be fixed to the rotation shaft 101 using a known method.

The fixed collar 103 is formed of a pipe-like resin member of POM or the like, has an inner diameter slightly smaller than the outer diameter of the fixed collar portion 101D of the rotation shaft 101, and is press-fitted to the fixed collar portion 101D of the rotation shaft 101 by fitting the fixed collar 103 to the rotation shaft 101 in the axis direction thereof. In this exemplary embodiment, the peripheral surface of the fixed collar 103 is subjected to, for example, a roughening process to form a frictional-resistance layer, thereby further increasing the frictional force with respect to the transfer belt 53. Reference numeral 106 in the drawing represents a press-fitting portion to which the fixed collar 103 is press-fitted.

On the other hand, the free collar 104 is formed of a pipe-like resin member of POM or the like and has an outer diameter substantially equal to the outer diameter of the fixed collar 103, and the inner diameter thereof is set to be slightly larger than the outer diameter of the large-diameter portion 101C so as to form, a micro gap from the large-diameter portion 101C of the rotation shaft 101. In this exemplary embodiment, the sliding property between the free collar 104 and the rotation shaft 101 is improved by employing the resin such as POM for the free collar 104 and thus the free collar 104 may excellently rotate independently of the rotation shaft 101. In order to reduce the fractional force between the free collar 104 and the transfer belt 53, for example, a fluorine-based resin layer (not shown) may be formed, as a lubricant layer formed of a resin layer having frictional resistance with the transfer belt 53 smaller than that of the material of the free collar 104, on the peripheral surface of the free collar 104.

Figure 6A:
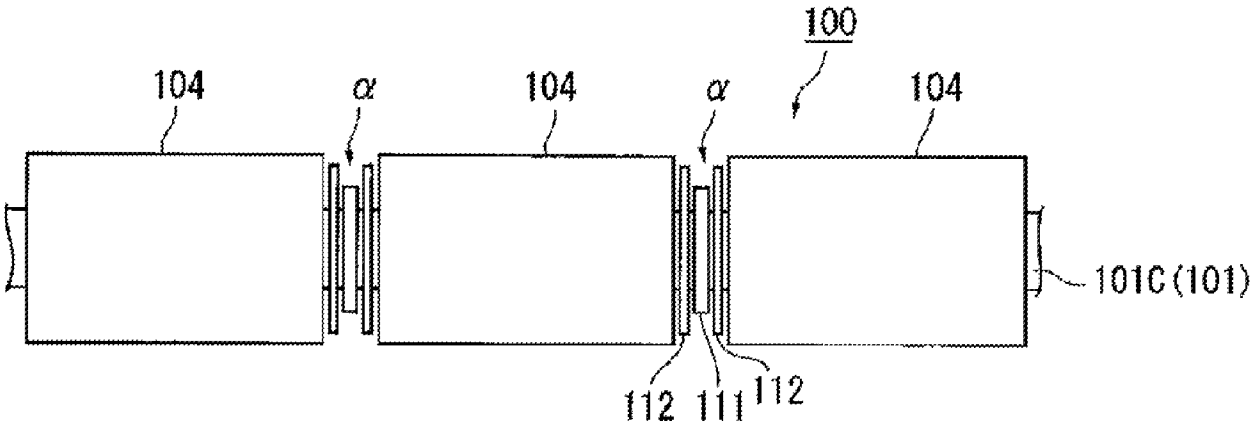
FIGS. 6A and 6B are diagrams schematically illustrating a free collar attaching structure to a rotation shaft.

An example where such free collars 104 are attached to the rotation shaft 101 (specifically, the large-diameter portion 101C) is shown in FIG. 6A. As shown in the drawing, an E ring 111 and two spacers 112 formed of a material having a good lubrication property with respect to the free collar 104 on both sides of the E ring 111 are disposed in an α part between the free collar 104 and the free collar 104, whereby the movement of the free collar 104 in the axis direction is regulated by the E ring 111. Here, a micro gap is formed between the free collars 104 and between the free collar 104 and the fixed collar 103 so as to allow the free collars 104 to move in the axis direction. Therefore, the free collar 104 has the micro gap in both the diameter direction and the axis direction of the rotation shaft 101 and thus rotates independently of the rotation shaft 101. The micro gap may be appropriately selected from various dimensions so as to form an appropriate gap through experimental confirmation.

Figure 6B:
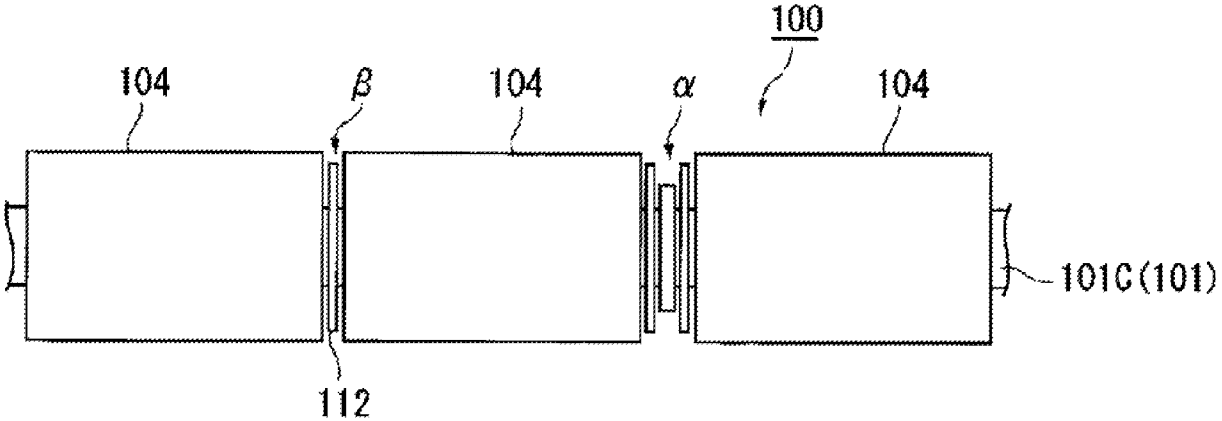

The free collar 104 may be attached to the rotation shaft 101 as shown in FIG. 6B. Only the spacer 112 may be interposed between a certain free collar 104 and a certain free collar 104 as indicated by a β part in the drawing. For example, when the free collar 104 is formed of the POM having a good sliding property with respect to metal, only the E ring 111 may be attached to the rotation shaft 101 without using the spacer 112. Out of plural free collars 104 arranged adjacently in the axis direction of the rotation shaft 101, the E ring 111 may be disposed on only the outside of the free collars 104 located at both ends and the total gap between the plural free collars 104 may be set to a predetermined value.

Operation of Image Forming Apparatus

The operation of the image forming apparatus according to this exemplary embodiment will be described below. As shown in FIG. 3, the image forming units 20 (20*a* to 20*d*) form color toner images on the corresponding photoreceptors 21 in synchronization with the rotation of the intermediate transfer belt 30. The toner images formed on the photoreceptors 21 are sequentially primarily transferred to the intermediate transfer belt 30 by the primary transfer devices 25 and are multiplexed on the intermediate transfer belt 30. The toner image multiplexed on the intermediate transfer belt 30 is transferred to a recording medium P by the transfer device 50 in a lump. The recording medium P to which the toner image is transferred is absorbed and transported by the transfer belt 53 without being attached to the intermediate transfer belt 30 due to the transfer electric field at the time of the secondary transfer. The recording medium P peeled off from the transfer belt 53 at the position of the follower roll 52 is transported to the fixing device 43 via the transport belt 42 and the recording medium P subjected to the fixation by the fixing device 43 is discharged from the apparatus by the discharge roll 44.

General Behavior of Intermediate Transfer Belt

The general behavior of the intermediate transfer belt will be described before describing the operation of the inertial roll 100 in this exemplary embodiment.

In general, for example, in an image forming apparatus employing an endless belt member supported by plural support rolls, particularly, in a so-called tandem type color image forming apparatus multiplexing plural toner images on the intermediate transfer belt, it is important to move the intermediate transfer belt at a stable velocity. In such an image forming apparatus, a variation in load occurs due to an inrush of a recording medium into the secondary transfer part when the multiplexed toner image is transferred (secondarily transferred) to the recording medium from the intermediate transfer belt. When the intermediate transfer belt causes a variation in velocity due to the variation in load, image defects such as an image shift may be caused, for example, at the time of transferring (primarily transferring) the toner image to the intermediate transfer belt.

In order to suppress the variation in velocity of the endless belt member such as the intermediate transfer belt, it is known that a flywheel is attached to the support roll. The flywheel serves to suppress the variation in velocity of a belt member with the moment based on the inertial force. As the outer diameter ox the support roll having the flywheel attached thereto decreases at the same belt velocity, the rotational acceleration increases and the effect of the inertial force is better achieved. However, the flywheel has a disk shape having a large outer diameter in order to achieve a large moment of inertia with a small mass. As a result, it is necessary to consider the installation space reflecting the size of the flywheel or the outer diameter of the support roll having the flywheel attached thereto. Since the flywheel is generally formed of metal so as to increase the mass, it is necessary to consider that it is difficult to arrange the flywheel in the vicinity of a position at which a high electric field such as a transfer electric field is applied.

On the other hand, when it is intended to cause the belt member to stably move, it is necessary to suppress the meandering or the occurrence of creases in the belt member. When the belt member having the meandering or creases is made to continuously move, it is difficult to maintain the stable movement, thereby causing defective image quality. Therefore, when it is intended to cause the endless belt member to stably move, it is necessary to realize the movement in which the meandering or the occurrence of creases is suppressed and the variation in velocity is suppressed even when an unexpected load variation occurs.

Before the operation of the inertial roll 100 in this exemplary embodiment is described, the operation of a belt member 300 on a follower roll 200 (not including the fixed collar or the free collar) according to the related art will be described with reference to FIGS. 10A and 10B. When a flywheel is provided to the follower roll 200, the inertial force of the flywheel is transmitted from the follower roll 200 to the belt member 300. However, the meandering or the occurrence of a crease in the belt member 300 is greatly different from those in this exemplary embodiment.

Figure 10A:
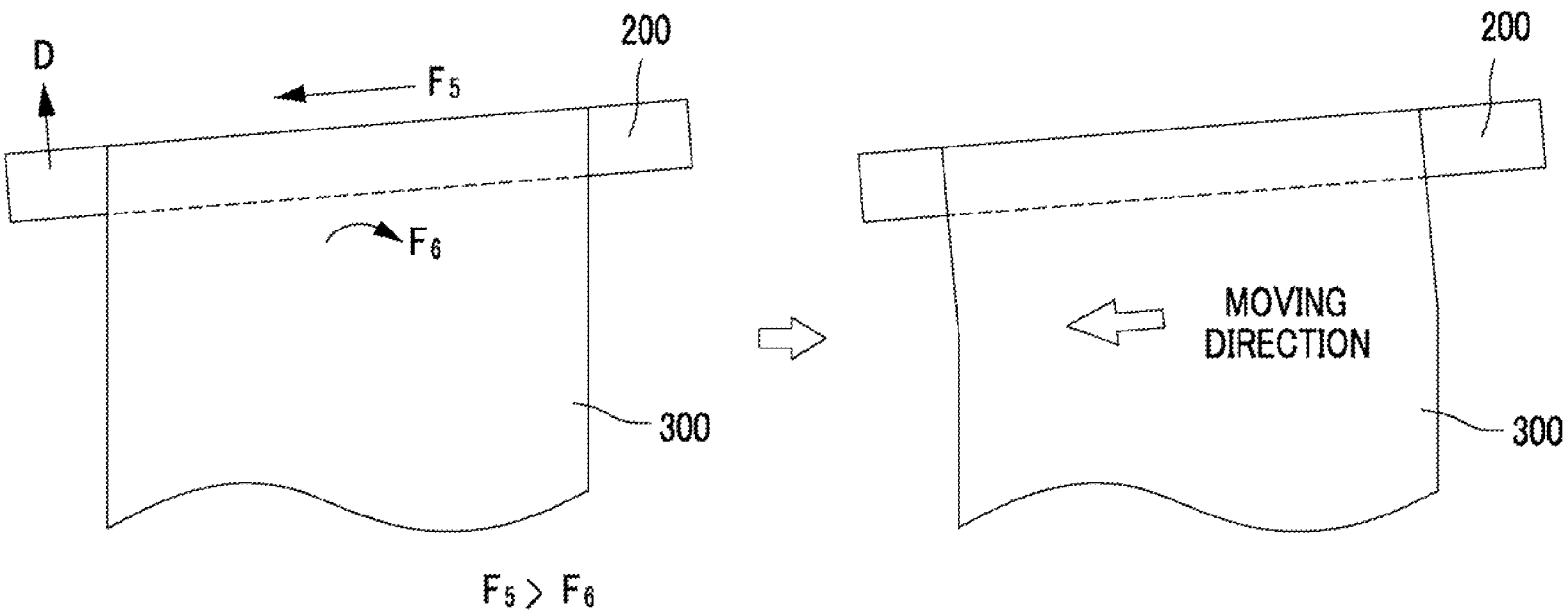
FIGS. 10A and 10B are diagrams illustrating various operations when a known follower roll is used in a comparative embodiment.

FIG. 10A shows the meandering of the belt member 300 according to a comparative example, where the follower roll 200 is inclined. At this time, as shown in the left side of the drawing, a force $F_6$ directed to the left side in the drawing is applied to the belt member 300 through the frictional force about the follower roll 200, due to the angular difference between the direction in which the belt member 300 is wound on the follower roll 200 and the rotation direction D of the follower roll 200. The rotational moment (the force $F_6$ in the direction in which the movement of the belt member 300 is suppressed) of the internal force is applied to the belt member 300. However, since $F_5>F_6$, the belt member 300 meanders as shown in the right drawing.

Figure 10B:
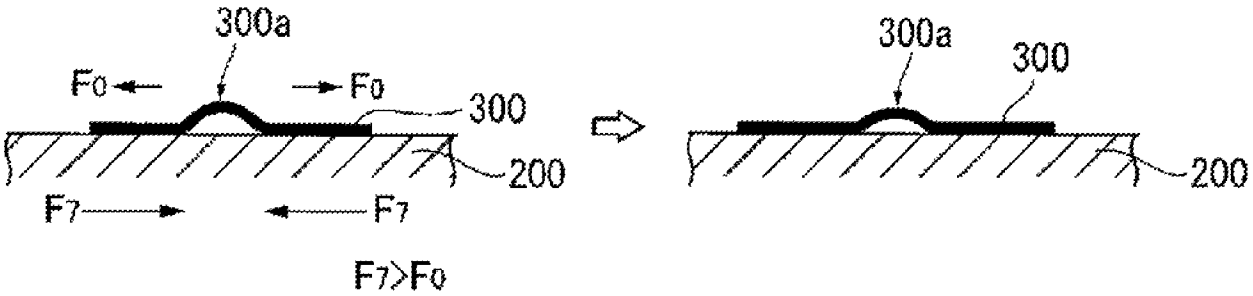

FIG. 10B shows a crease in the belt member 300 according to the comparative example, where a crease 300*a* occurs in the belt member 300 in the left drawing. At this time, since the frictional force $F_7$ between the belt member 300 and the follower roll 200 is greater than the internal force $F_0$ of the belt ($F_7>F_8$), the force in the direction in which the belt member 300 is stretched is suppressed and the crease 300*a* in the belt member 300 is maintained as shown in the right drawing.

The meandering or the crease is improved by employing a configuration in which the follower roll includes a member corresponding to the free collar in this exemplary embodiment around the fixed shaft. However, when such a follower roll is used, it is not possible to attach the flywheel to the follower roll and to cope with the unexpected load variation.

Operation of Inertial Roll

In consideration of the above-mentioned points, the follower roll 52 supporting the transfer belt 53 is constructed by the inertial roll 100 in this exemplary embodiment. The operation of the inertial roll 100 is considered as follows.

Inertial Force

The inertial force will be described below. For example, as shown in FIG. 4, since the flywheel 102 in this exemplary embodiment is disposed in the follower roll 52 having an outer diameter smaller than that of the transfer roll 51, but not in the transfer roll 51, the inertial force is greater than that in the case where the same flywheel 102 is disposed in the transfer roll 51. Since the fractional force between the fixed collar 103 and the transfer belt 53 is sufficiently secured by the fixed collar 103, the inertial force of the flywheel 102 is effectively transmitted to the transfer belt 53 via the fixed collar 103.

Meandering

Figure 7:
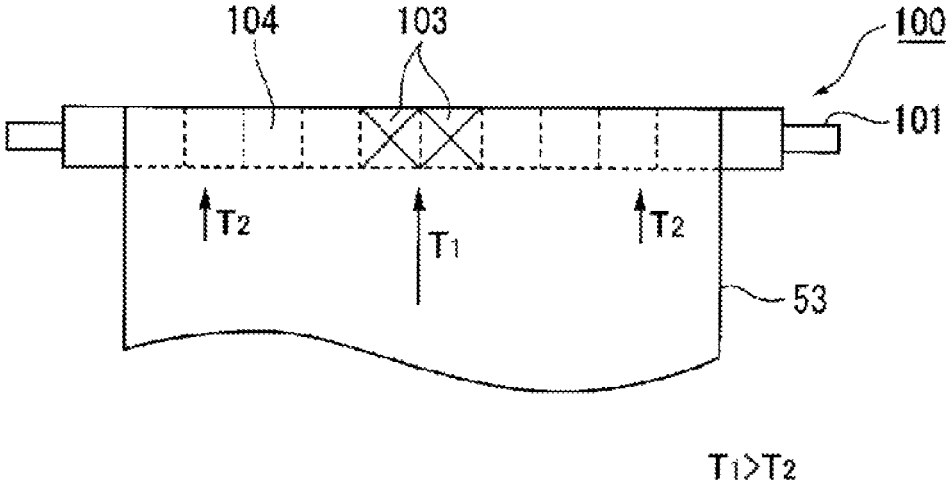
FIG. 7 is a diagram illustrating the arrangement of a fixed collar of the inertial roll according to the first exemplary embodiment.

The meandering will be described below. FIG. 7 is a diagram schematically illustrating the relationship between the inertial roll 100 and the transfer belt 53 in this exemplary embodiment, where two roll-divided members at the center are the fixed collars 103 and the other roll-divided members are the free collars 104. When the fixed collars 103 and the free collars 104 are arranged in this way, the fixed collars 103 rotate along with the rotation shaft 101 and the free collars 104 freely rotate independently of the rotation of the rotation shaft 101.

At this time, a tension $T_1$ based on the fixed collars 103 and a tension $T_2$ based on the free collars 104 are applied to the transfer belt 53, but the tension $T_1$ based on the fixed collars 103 is sufficiently larger than the tension $T_2$ based on the free collars 104 ($T_1>T_2$). Particularly, in this exemplary embodiment, since the free collars 104 have a micro gap from the rotation shaft 101, the actual outer diameter for the transfer belt 53 is smaller by the micro gap than that of the fixed collars 103. Since the fixed collars 103 include the frictional-resistance layer, the difference in tension further increases.

Figure 8A:
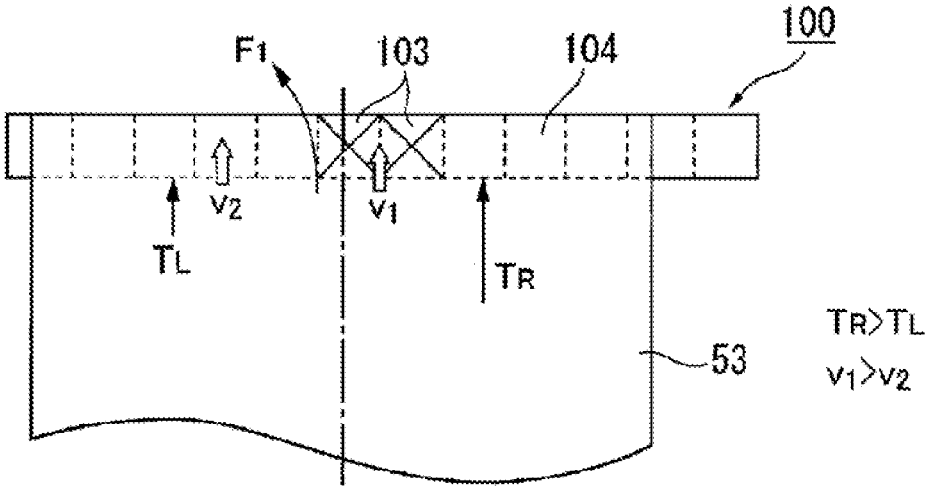
FIGS. 8A to 8C are diagrams illustrating an operation when a transfer belt deviates in the first exemplary embodiment.
Figure 8B:
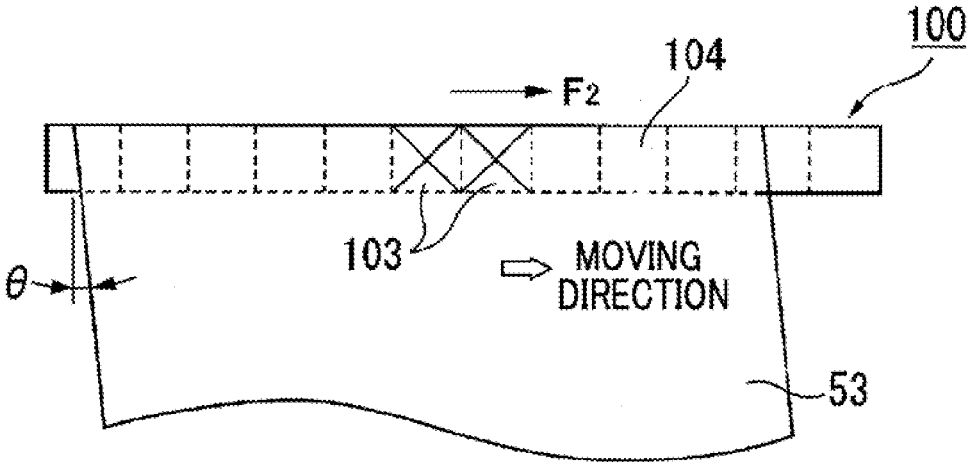

Regarding such a transfer belt 53, as shown in FIG. 8A, it is assumed that the transfer belt 53 is shifted to the left side in the drawing. Here, since the actual outer diameter of the free collars 104 is smaller by the micro gap from the rotation shaft 101 than that of the fixed collars 103, the rotation velocity $v_1$ of the transfer belt 53 at the positions of the fixed collars 103 is greater than the rotation velocity $v_2$ at the positions of the free collars 104 ($v_1>v_2$). Accordingly, the transfer belt 53 is more stretched at the position of the fixed collars 103 than at the positions of the free collars 104, and the tension $T_R$ in the right half of the transfer belt 53 is greater than the tension $T_R$ in the left half ($T_R>T_L$). As a result, a force $F_1$ based on a torsion moment is applied to the transfer belt 53 and thus the transfer belt 53 is inclined by a micro angle θ as shown in FIG. 8B.

Figure 8C:
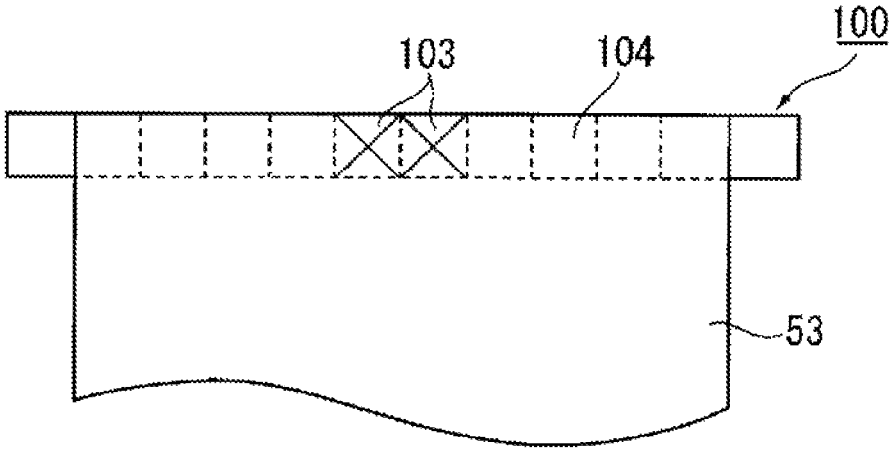

When such a micro angle θ is formed, a difference between the direction in which the transfer belt 53 is wound on the inertial roll 100 and the rotation direction of the inertial roll 100 occurs and the force $F_2$ directed to the right side in the drawing is applied through the frictional force about the inertial roll 100 (mainly the friction force about the fixed collars 103), whereby the transfer belt 53 slowly moves to the right side. As shown in FIG. 8C, when the fixed collars 103 are located substantially at the center in the width direction of the transfer belt 53, the movement of the transfer belt 53 is ended.

It has been stated above that the fixed collars 103 are subjected to a roughening process as a frictional-resistance layer so as to effectively transmit the inertial force of the flywheel 102 to the transfer belt 53, but the same operation is achieved even when the outer diameter of the fixed, collars 103 is set to be greater than the outer diameter of the free collars 104.

Crease

Figure 9A:
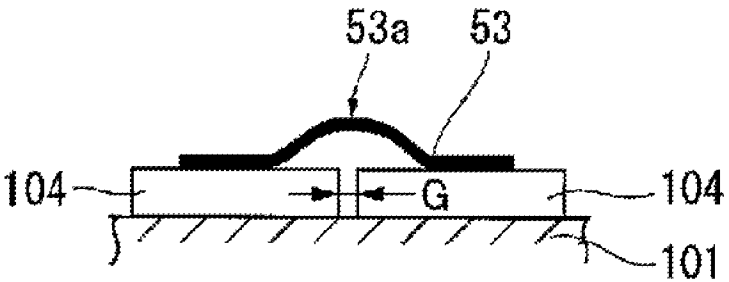
FIG. 9A is a diagram schematically illustrating a state where a crease is formed in the transfer belt.
Figure 9B:
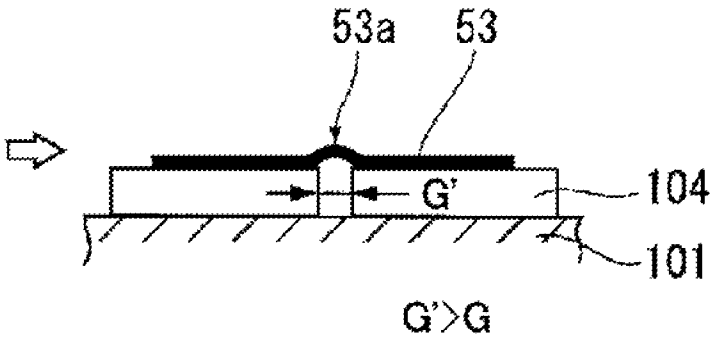
FIG. 9B is a diagram schematically illustrating a state where the crease is stretched.
Figure 9C:
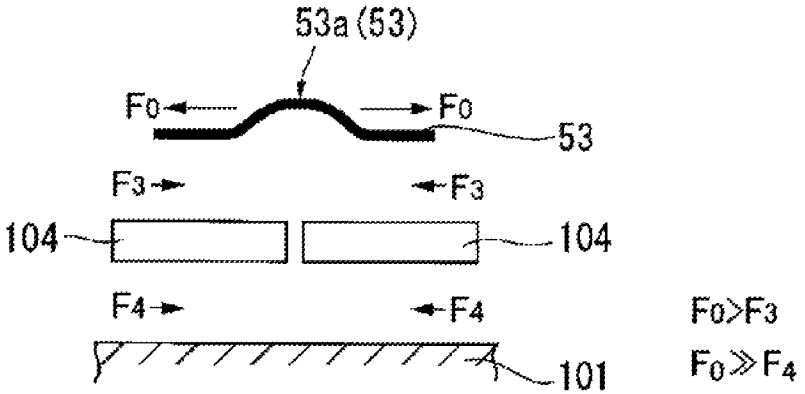
FIG. 9C is a diagram schematically illustrating forces acting on members at that time.

FIG. 9A is a diagram schematically illustrating a state where a crease 53*a* occurs in the transfer belt 53, FIG. 9B is a diagram schematically illustrating a state where the crease 53*a* is stretched, and FIG. 9C shows the forces acting on the members at that time.

Here, when it is intended to maintain the state where the crease 53*a* of the transfer belt 53 remains between the free collars 104 as shown in FIG. 9A, a frictional force (the force causing the transfer belt 53 to stay at that position) greater than the internal force $F_0$ of the belt due to the distortion of the transfer belt 53 is necessary. Since the free collars 104 in this exemplary embodiment have the micro gap in the diameter direction of the rotation shaft 101 and the micro gap G in the axis direction thereof, the frictional force $F_4$ between the free collars 104 and the rotation shaft 101 becomes very small ($F_0>F_4$). Even when the friction force $F_3$ on the contact surface between the transfer belt 53 and the free collars 104 is great ($F_0>F_3$), the micro gap G in the axis direction increases (increase of G->G') as shown in FIG. 9B and thus the frictional force causing the transfer belt 53 to stay at that position does not act and the crease goes in the direction in which the crease is stretched due to the internal force $F_0$ of the transfer belt 53.

Here, the free collars 104 may not have the micro gap G in the axis direction of the rotation shaft 101 (for example, a configuration in which the free collar 104 is long in the axis direction or a configuration in which the free collar 104 is supported by the rotation shaft 101 with bearings interposed therebetween may be employed). In this case, when the frictional force $F_3$ between the free collar 104 and the transfer belt 53 is reduced, the transfer belt 53 slides over the surface of the free collar 104 to stretch the crease. When it is assumed that a crease occurs at a position at which it comes in contact with the fixed collar 103, the crease is transmitted to the free collar 104 through the rotation of the transfer belt 53 and is slowly stretched. When, a lubricant layer is formed on the peripheral surface of the free collar 104 so as to further reduce the frictional force $F_3$ between the free collar 104 and the transfer belt 53, the crease is better stretched.

As described above, in this exemplary embodiment, since the inertial roll 100 includes the fixed collar 103 and the free collar 104 in addition to the flywheel 102, it is possible to effectively transmit the inertial force of the flywheel 102 to the transfer belt 53 while suppressing the meandering or the occurrence of a crease in the transfer belt 53. Since the inertial roll 100 is disposed in a place other than the transfer roll 51, the outer diameter thereof is smaller than that of the transfer roll 51, the angular velocity of the inertial roll 100 along the rotation of the transfer belt 53 increases, and thus the inertial force of the flywheel 102 also increases. It is not necessary to consider the influence of a transfer electric field, compared with a case where the flywheel 102 is attached to the transfer roll 51.

In this exemplary embodiment, for example, when a recording medium P rushes into the secondary transfer part, the load of the intermediate transfer belt 30 varies, but this load variation also occurs in the transfer belt 53. However, in this exemplary embodiment, since the inertial roll 100 is disposed on the transfer belt 53 side, the occurrence of the velocity variation of the transfer belt 53 due to the load variation is suppressed. As a result, the velocity variation in the transfer belt 53 is suppressed and thus the velocity variation in the intermediate transfer belt 30 is also suppressed.

Since the meandering or the occurrence of a crease in the transfer belt 53 is suppressed, the intermediate transfer belt 30 also moves more stably.

The number of fixed collars 103 and the number of free collars 104 are not limited to the example shown in the drawings, but may be appropriately selected by confirming the relationship with the transfer belt 53 through an experiment or the like. The lengths in the axis direction of the fixed collars 103 and the free collars 104 may be appropriately selected.

In this exemplary embodiment, the fixed collars 103 and the free collars 104 are formed of a resin, but the fixed collars 103 may be formed of a metal and the free collars 104 may be formed of a resin, or both, are formed of a metal. A convex portion or a concave portion in the diameter direction may be formed in the fixed collars 103 and the rotation shaft 101 and both may be press-fitted to each other by positioning the convex or concave portions. In this exemplary embodiment, as shown in FIG. 5, the fixed collar portion 101D of the rotation shaft 101 is set to be thicker than that large-diameter portion 101C to which the free collars 104 are attached so as to use the fixed collars 103 having the same shape as the free collars 104, but the inner diameter of the fixed collars 103 may be changed so that the fixed collar portion 101D has the same diameter as the large-diameter portion 101C.

In this exemplary embodiment, the image forming apparatus shown in FIG. 3, that is, the image forming apparatus including four image forming units 20, has been described, but the image forming apparatus is not limited to this example and the number of image forming units 20 is not limited. As long as the intermediate transfer belt 30 is used, an image forming apparatus in which plural color toner images are formed by the use of a single image forming unit 20 may be used.

In the transfer device 50 according to this exemplary embodiment, a driving system is not provided to the transfer roll 51, but a driving motor may be attached to the transfer roll 51, for example, with a torque limiter interposed therebetween to drive the transfer roll 51. In this case, the transport stability of a recording medium P in the second transfer part is further enhanced.

In this exemplary embodiment, the meandering or the occurrence of a crease in the transfer belt 53 is suppressed and the velocity variation in the transfer belt 53 is suppressed by using the inertial roll 100 as the follower roll 52 supporting the transfer belt 53, thereby suppressing the velocity variation of the intermediate transfer belt 30, but such an inertial roll 100 may be applied to suppress the meandering or the occurrence of a crease in an endless belt member circulating and to suppress the velocity variation of the belt member may be suppressed.

Figure 11A:
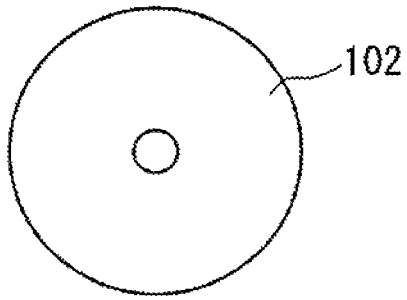
FIGS. 11A to 11C are diagrams schematically illustrating various shapes of a flywheel.
Figure 11B:
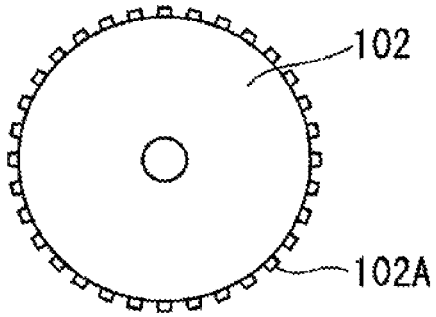
Figure 11C:
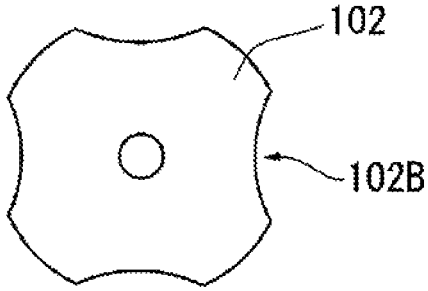

The shape of the flywheel 102 is not particularly limited, as long as it may stably rotate, and examples thereof are shown in FIGS. 11A to 11C. FIG. 11A shows a flywheel 102 having a disk shape. FIG. 11B shows a flywheel 102 having a saw-teethed protrusion 102A on the outer periphery of a disk, and FIG. 11C shows a flywheel 102 having arc-like cuts 102B in parts of the outer periphery of a disk. With these shapes, particularly, with the flywheel 102 having the shape shown in FIG. 11B or 11C, for example, when it is intended to rapidly stop the flywheel 102, the rotation of the flywheel 102 is easily stopped by bringing a member into contact with the saw-teethed protrusions 102A or the arc-like cuts 102B.

Modified examples of the inertial roll 100 (see FIG. 5 and the like) used in the first exemplary embodiment will be described below.

Modified Example 1

Figure 12A:
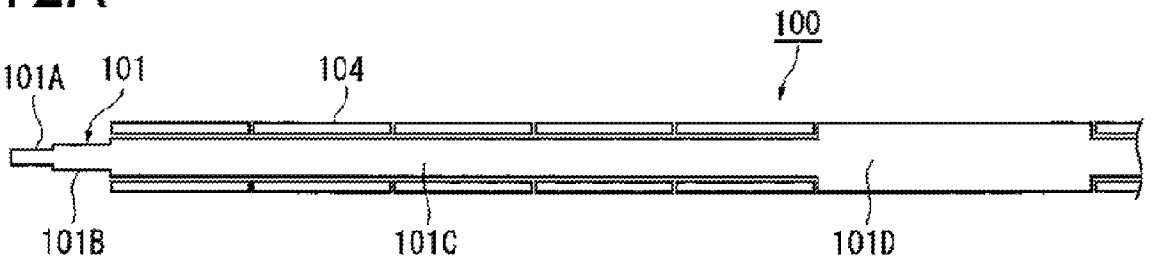
FIGS. 12A to 12C are diagrams schematically illustrating the configuration of fixed collars and free collars in Modified Example 1.
Figure 12B:
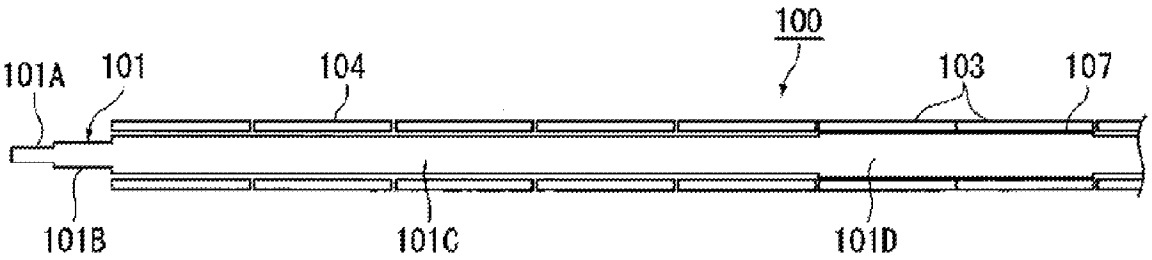
Figure 12C:
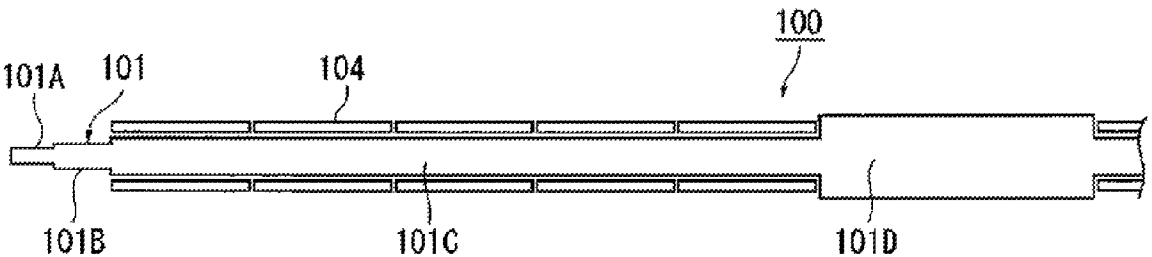

FIGS. 12A to 12C show various modified examples of the fixed collar 103 in the inertial roll 100. The fixed collar 103 in the first exemplary embodiment is configured to be press-fitted to the rotation shaft 101, but the fixed collar portion 101D having the largest outer diameter in the rotation shaft 101 is used instead of the fixed collar 103 in FIG. 12A. Here, the outer diameter of the fixed collar portion 101D is set to be substantially equal to the outer diameter of the free collar 104 and the peripheral surface thereof is roughened to enhance the frictional force with the transfer belt 53. Even when such an inertial roll 100 is used, the same operational advantages as in the first exemplary embodiment may be achieved. Instead of roughening the peripheral surface of the fixed collar portion 101D, for example a polyamide resin may be applied thereto to enhance the frictional force with the transfer belt 53.

In FIG. 12B, the fixed collar 103 is bonded and fixed to the fixed collar portion 101D of the rotation shaft 101 with an adhesive portion 107 using an adhesive. Even when such a fixed collar 103 is used, the same operational advantages as in the first exemplary embodiment may be achieved.

In FIG. 12C, by using the fixed collar portion 101D instead of the fixed collar 103 as shown in FIG. 12A, particularly, the outer diameter of the fixed collar portion 101D is set to be larger than the outer diameter of the free collar 104. In this way, by setting the thickness of the fixed collar portion 101D to be greater than that of the free collar 104, the tension in the fixed collar portion 101D (corresponding to the fixed collar 103) further increases, thereby further suppressing the meandering of the transfer belt 53 or the occurrence of a crease therein and satisfactorily suppressing the velocity variation in the transfer belt 53. The example where the fixed collar portion 101D having a large outer diameter is used has been described, but a structure in which a fixed collar 103 having a large outer diameter is press-fitted or bonded to the rotation shaft 101 independently of the rotation shaft 101 may be employed. A frictional-resistance layer raising the frictional force may be formed on the peripheral surface of the fixed collar 103. The outer diameter may be set to a range in which a level difference from the free collar 104 does not cause any problem through a preliminary experiment.

Modified Example 2

Figure 13A:
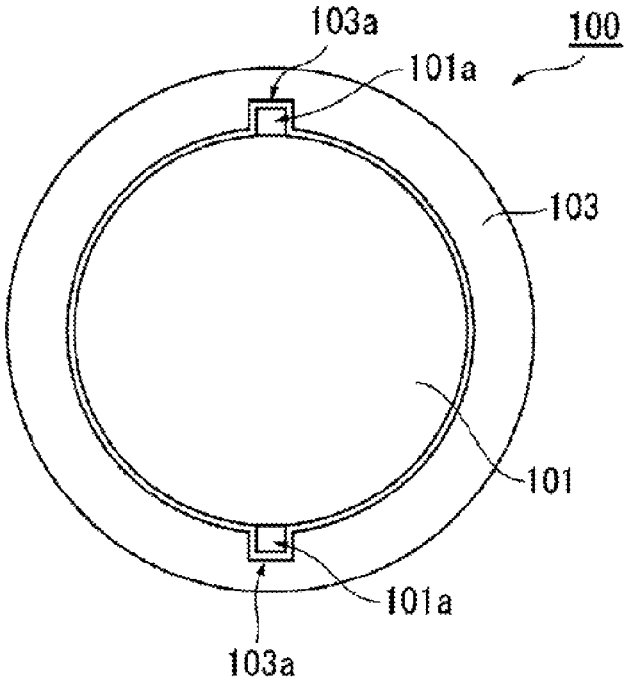
FIG. 13A is a diagram schematically illustrating the relationship between a fixed collar and a rotation shaft in an aspect of Modified. Example 2
Figure 13B:
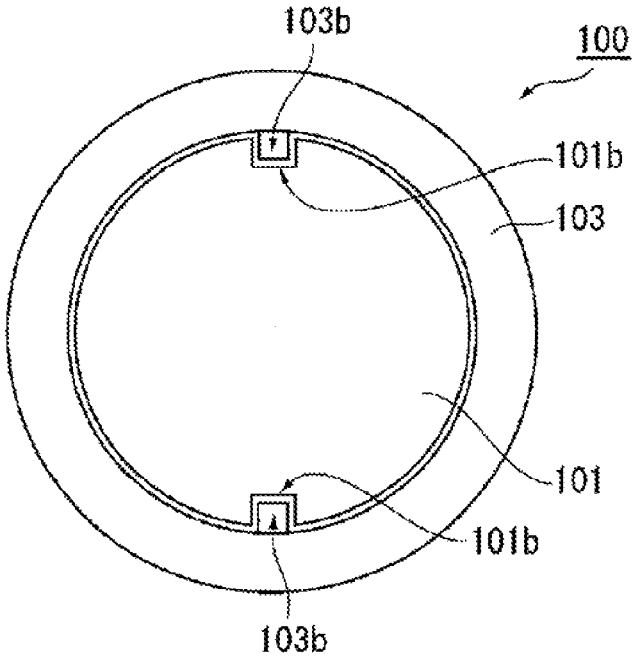
FIG. 13B is a diagram schematically illustrating the relationship between a fixed collar and a rotation shaft in another aspect of Modified Example 2.

FIGS. 13A and 13B show another modified example of the fixed collar 103 in the inertial roll 100. In this modified example, convex portions and concave portions engaging with each other are formed in the fixed collar 103 and the rotation shaft 101 and the fixed collar 103 is positioned with respect to the rotation shaft 101 by inserting the fixed collar 103 along the axis direction of the rotation shaft 101. In this modified example, since the concave portions and the convex portions are configured to have a micro gap in the rotation direction, the engagement thereof is simply carried out.

In FIG. 13A, for example, a particular member is attached to the rotation shaft 101 to form two convex portions 101*a* and two concave portions 103*a* formed of, for example, a groove are formed in the fixed collar 103. In FIG. 13B, two concave portions 101*b* are formed in the rotation shaft 101 and two convex portions 103*b* are formed in the fixed collar 103.

The concave portions or the convex portions need not be formed over all the length in the axis direction of the fixed collar 103, as long as the fixed collar 103 may rotate along with the rotation shaft 101. However, from the viewpoint of facilitating the attachment of the fixed collar 103 to the rotation shaft 101, it is preferable that the concave portions be formed over all the length in the axis direction. The concave portions and the convex portions may be formed in both the rotation shaft 101 and the fixed collar 103.

Figure 14:
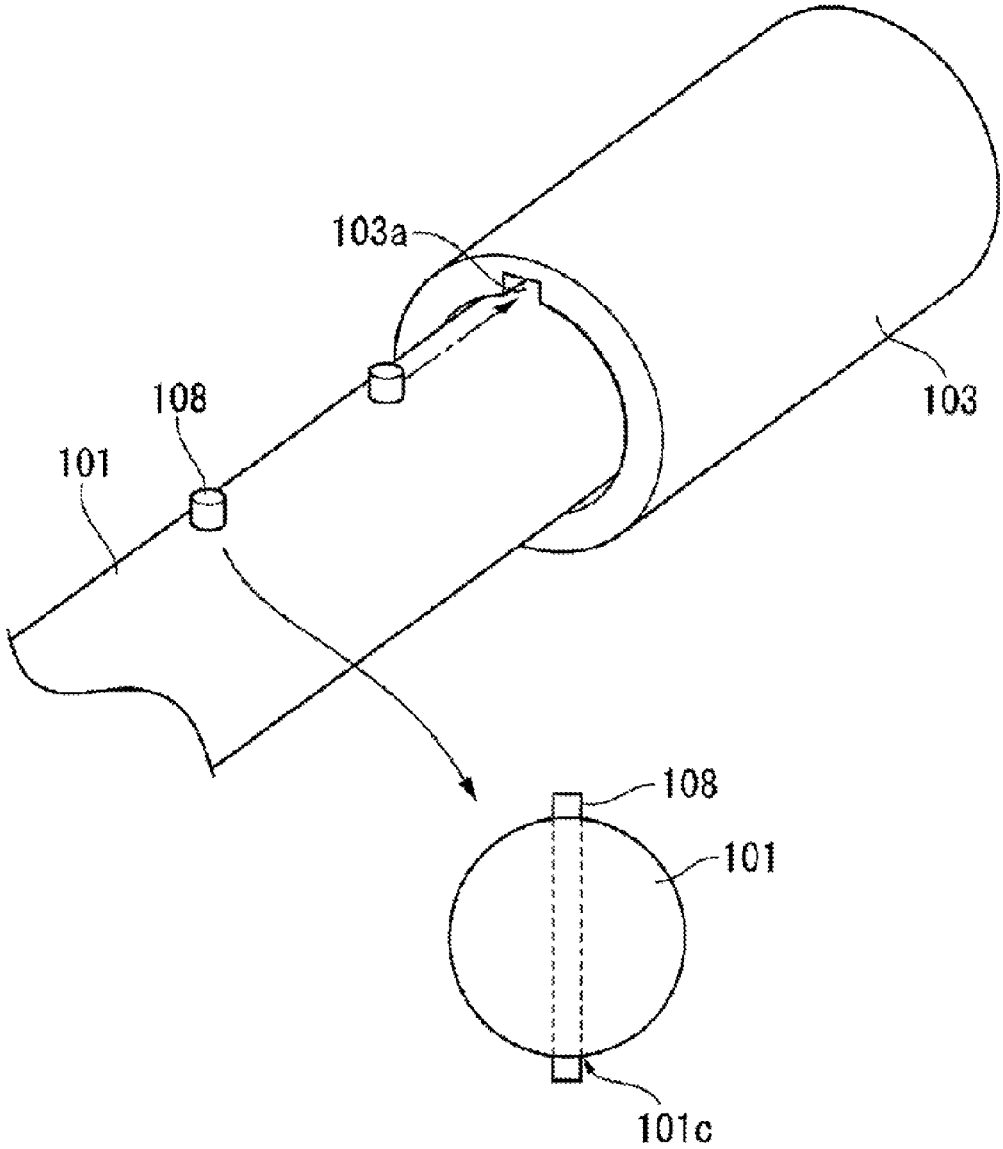
FIG. 14 is a perspective view illustrating an example of FIG. 13A.

In this way, by causing the concave portion and the convex portion to engage with each other, the attachment of the fixed collar 103 to the rotation shaft 101 is facilitated and, for example, press-fitting or adhesion is not necessary. In this way, by causing the fixed collar 103 and the rotation shaft 101 to engage with each other, both the fixed collar 103 and the rotation shaft 101 rotate together even when there is a gap along the rotation direction therebetween after the engagement. Particularly, in the example where the concave portion 103*a* are formed in the fixed collar 103, a simpler configuration may be employed as shown in FIG. 14. In the drawing, grooves in the axis direction are formed as the concave portions 103*a* in the fixed collar 103. On the other hand, a hole 101*c* is formed in the diameter direction in the rotation shaft 101 and a pin 108 is inserted into the hole 101*c* so that both ends of the pin 108 protrude from the rotation shaft 101. Then, by inserting the protruding portions of the pin 108 into the concave portions 103*a* of the fixed collar 103, the rotation shaft 101 and the fixed collar 103 both rotate together at the time of rotation of the rotation shaft 101.

Second Exemplary Embodiment

Figure 15:
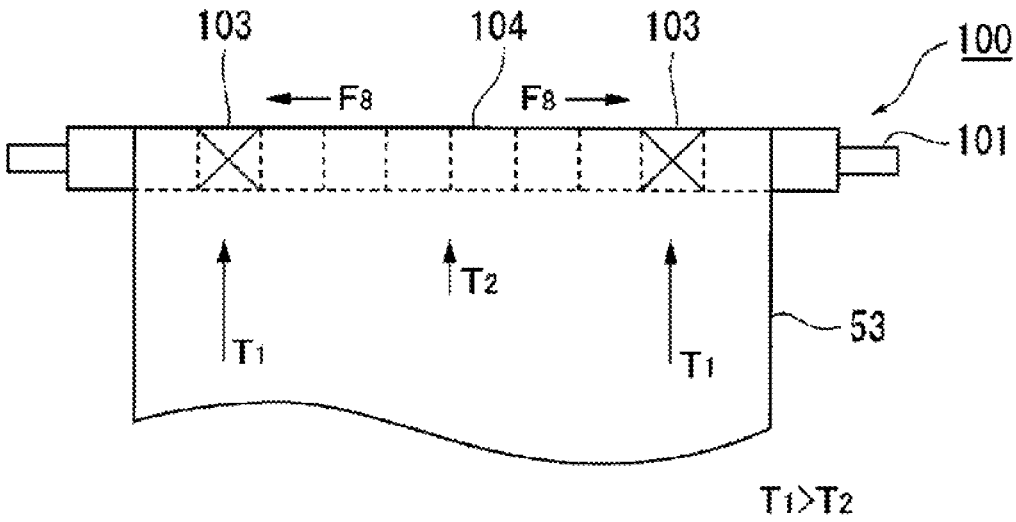
FIG. 15 is a diagram illustrating the arrangement of fixed collars in an inertial roll according to a second exemplary embodiment ox the invention.

FIG. 15 is a diagram schematically illustrating the arrangement of a fixed collar 103 in an inertial roll 100 according to a second exemplary embodiment. Although the fixed collars 103 are disposed at the center in the first exemplary embodiment, the fixed collars 103 are disposed separately on both sides in the second exemplary embodiment. The same elements as in the first exemplary embodiment will be referenced, by the same reference numerals and detailed description thereof will not be repeated.

Since the image forming apparatus according to this exemplary embodiment has the same configuration as that in the first exemplary embodiment, description thereof will not be repeated and the inertial roll 100 will foe described below.

In the inertial roll 100 according to this exemplary embodiment, as shown in FIG. 15, the free collars 104 are disposed at the center of the rotation shaft 101 and the fixed collars 103 are disposed on both sides thereof.

In this configuration, a tension $T_1$ based on the fixed collars 3 and a tension $T_2$ based on the free collars 104 are applied to the transfer belt 53, but the tension $T_1$ based on the fixed collars 103 is sufficiently larger than the tension $T_2$ based on the free collars 104 ($T_1>T_2$). Due to the difference in tension, a force F8 causing the transfer belt 53 to move to the fixed collars 103 acts on the transfer belt 53. Accordingly, at the position of the free collars 104 at the center, the transfer belt 53 is stretched to both fixed collars 103, thereby further suppressing the occurrence of a crease.

Figure 16A:
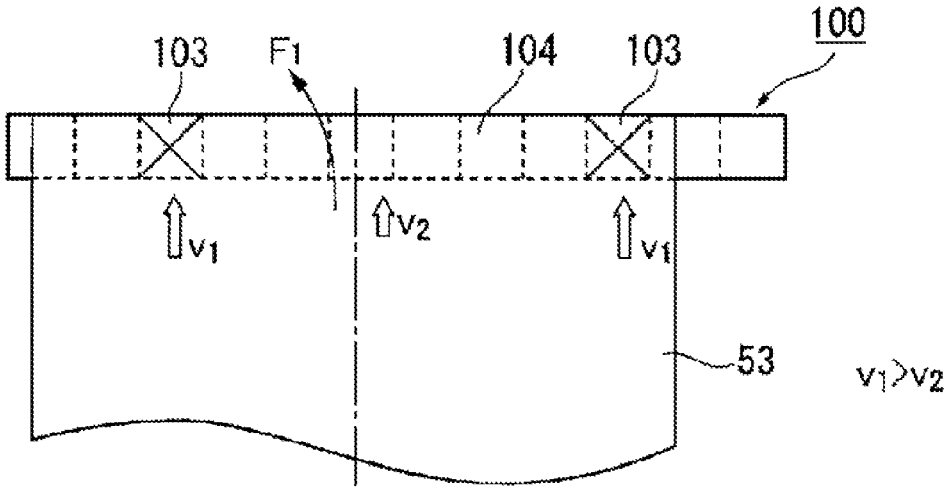
FIGS. 16A to 16C are diagrams illustrating an operation when a transfer belt deviates in the second exemplary embodiment.

The meandering of the transfer belt 53 in this exemplary embodiment is as follows. Here, when the transfer belt 53 is shifted to the left side in the drawing as shown in FIG. 16A, the rotation velocity $v_1$ of the transfer belt 53 at the positions of the fixed collars 103 is greater than the rotation velocity $V_2$ at the positions of the free collars 104 ($v_1>v_2$) and thus the transfer belt 53 is more stretched at the positions of the fixed collars 103 than at the positions of the free collars 104. As a result, since the force is asymmetrically applied to the transfer belt 53, a force $F_1$ based on a torsion moment acts thereon and thus the transfer belt 53 is inclined by a micro angle θ as shown in FIG. 16B.

Figure 16B:
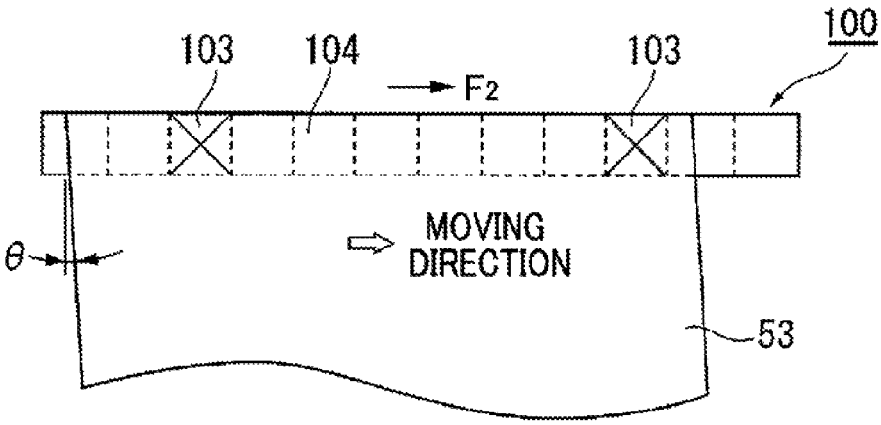
Figure 16C:
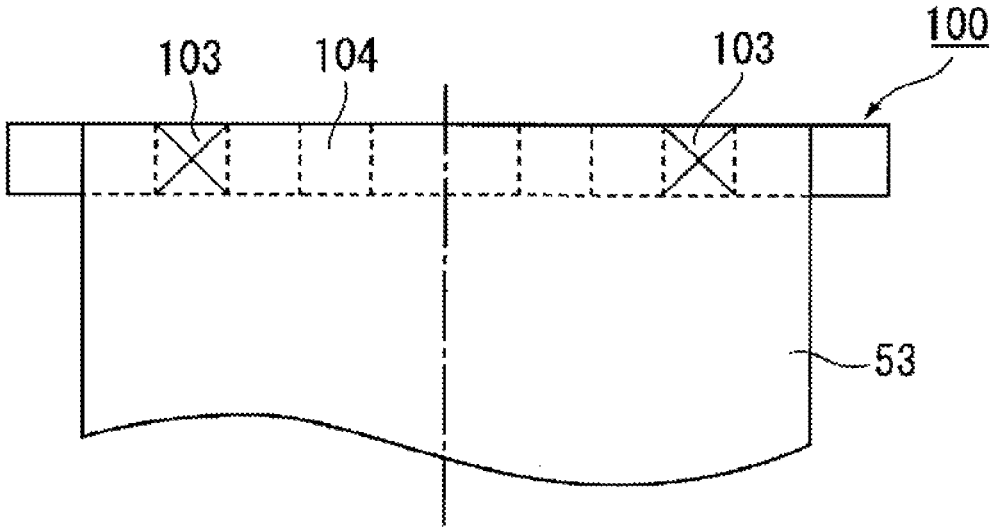

In the state shown in FIG. 16B, a difference between the direction in which the transfer belt 53 is wound and the rotation direction of the inertial roll 100 occurs due to the micro angle θ and a force $F_2$ causing the transfer belt 53 to move to the right side in the drawing through the friction force with the inertial roll 100 acts on the transfer belt 53, whereby the transfer belt 53 slowly moves to the right side. As shown in FIG. 16C, when the fixed collars 103 are arranged in the width direction of the transfer belt 53 to be substantially uniform over the transfer belt 53, the movement of the transfer belt 53 is ended.

In this exemplary embodiment, since the transfer belt 53 is attracted to the fixed collars 103 in the part of the transfer belt 53 corresponding to the free collars 104 between the fixed collars 103, the occurrence of a crease in that part is further suppressed, compared with the case where the fixed collars 103 are disposed at the center as in the first exemplary embodiment.

Regarding the meandering in this exemplary embodiment, even when the transfer belt 53 is deviated to one side in the axis direction but comes in contact with the fixed collar 103, such an operation is carried out. Accordingly, it is necessary to dispose the fixed collars 103 in the area in which the transfer belt 53 moves in the range where the meandering is assumed. The arrangement of the fixed collars 103 may be appropriately selected through preliminary experimental configuration.

In this exemplary embodiment, even when an unexpected load variation occurs in the transfer belt 53, the velocity variation is suppressed. In this exemplary embodiment, a frictional-resistance layer may be formed on the peripheral surface of the fixed collar 103 and a lubricant layer may be formed on the peripheral surface of the free collar 104. The outer diameter of the fixed collar 103 may be set to be larger than the outer diameter of the free collar 104. In this exemplary embodiment, since it is difficult to construct the fixed collar 103 as a part of the rotation shaft 101, a configuration facilitating assembly thereof may be appropriately selected.

Figure 17:
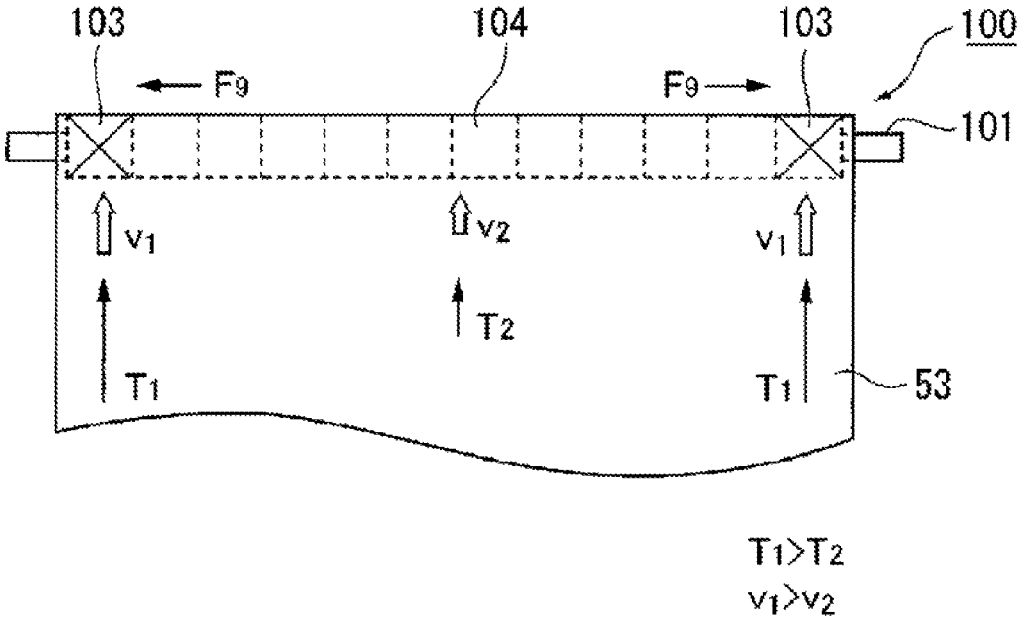
FIG. 17 is a diagram illustrating the arrangement of fixed collars in an inertial roll according to a modified example of the second exemplary embodiment.

FIG. 17 shows a modified example of this exemplary embodiment, where the fixed collars 103 are disposed at both ends of the rotation shaft 101 and the free collars 104 are arranged therebetween. The transfer belt 53 extends to exceed the fixed collars 103 at both ends. In this configuration, the rotation velocity $v_1$ of the transfer belt 53 at the positions of the fixed collars 103 is greater than the rotation velocity $v_2$ at the positions of the free collars 104 ($v_1>v_2$). Accordingly, the transfer belt 53 is more stretched at the positions of the fixed collars 103 than at the positions of the free collars 104, and the tension $T_1$ in the parts corresponding to the fixed collars 103 is greater than the tension $T_2$ in the parts corresponding to the free collars 104 ($T_1>T_2$). As a result, a force $F_9$ causing the transfer belt 53 to move to the fixed collars 103 from the center acts on the transfer belt 53.

In this modified example, when it is assumed that the transfer belt 53 is deviated from the fixed collars 103, the transfer belt 53 may easily move in the deviation direction. However, since the transfer belt 53 extends to the area exceeding the fixed collars 103, the transfer belt 53 comes in sufficient contact with the fixed collars 103, thereby causing no particular problem. Since the transfer belt 53 is attracted to both ends, the crease in the transfer belt 53 is stretched and the meandering is hardly caused. Regarding the meandering, a rib may be provided to the rear surface of the transfer belt 53 so as not to deviate from the fixed collars 103. With this configuration, the transfer belt hardly meanders, the occurrence of a crease is suppressed, and the velocity variation is satisfactorily suppressed in spite of an unexpected load variation.

Third Exemplary Embodiment

Figure 18A:
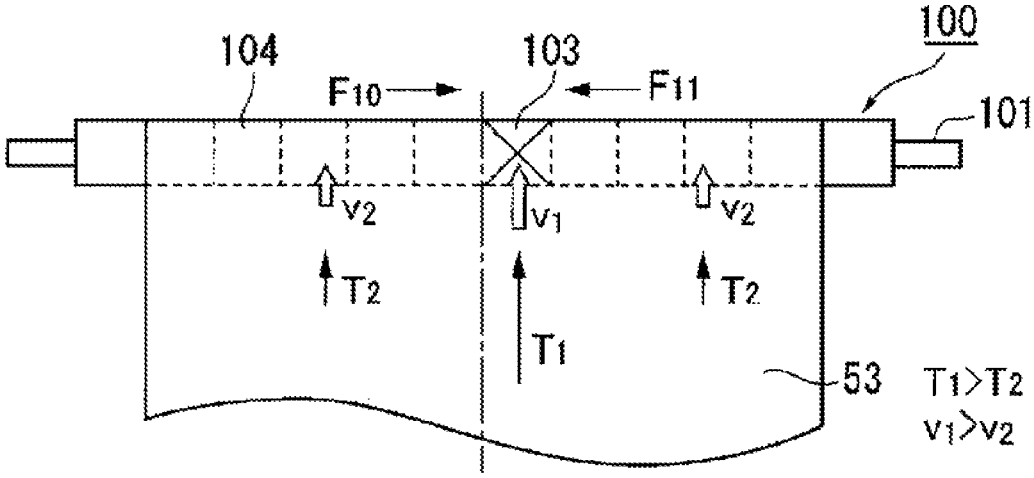
FIG. 18A is a diagram illustrating the arrangement of fixed collars in an inertial roll according to a third exemplary embodiment of the invention and FIG. 18B and 18C are diagrams illustrating an operation on a transfer belt in the third exemplary embodiment.
Figure 18B:
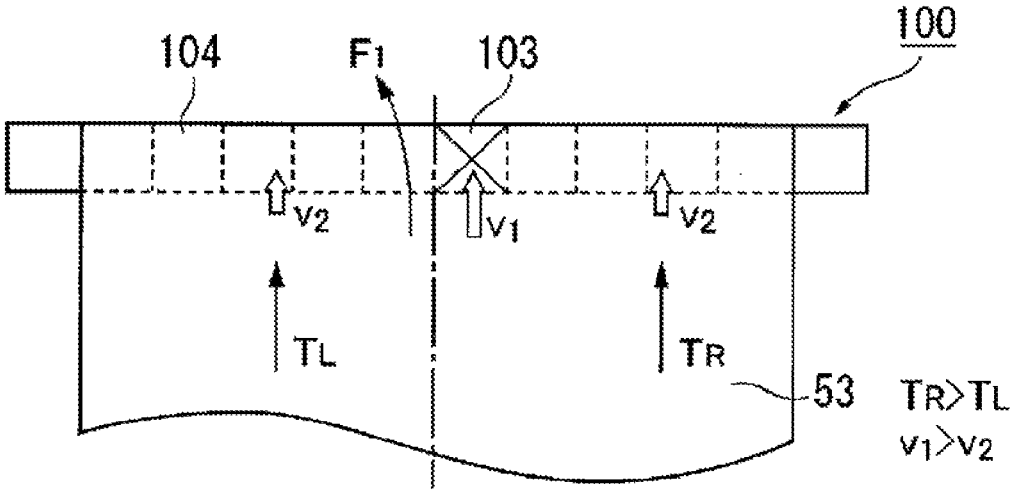
Figure 18C:
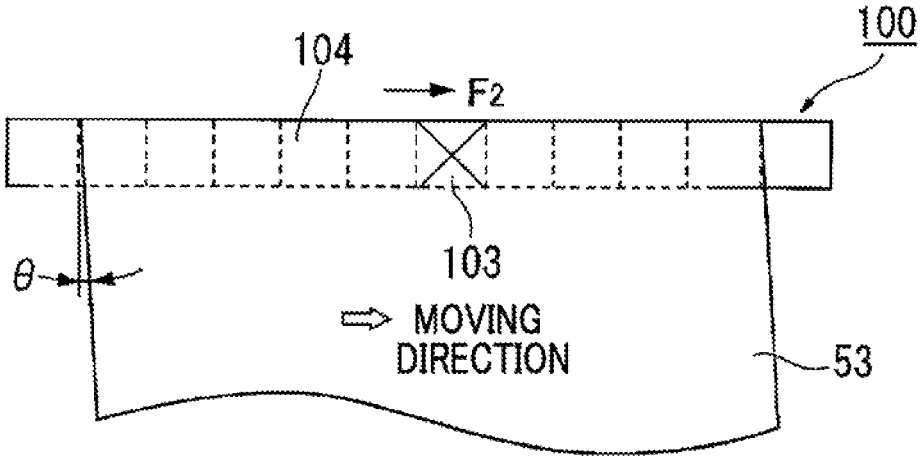

FIGS. 18A to 18C are diagrams schematically illustrating the arrangement of fixed collars 103 in an inertial roll 100 according to a third exemplary embodiment. Although the fixed collars 103 are disposed at the center in the first exemplary embodiment, the fixed collars 103 are disposed at a position slightly deviated from the center in the third exemplary embodiment. The same elements as in the first exemplary embodiment will be referenced by the same reference numerals and detailed description thereof will not be repeated.

Since the image forming apparatus according to this exemplary embodiment has the same configuration as that in the first exemplary embodiment, description thereof will not be repeated and the inertial roll 100 will be described below.

In the inertial roll 100 according to this exemplary embodiment, as shown in FIG. 18A, the fixed collar 103 is disposed at a position slightly deviated from the center of the rotation shaft 101 and the free collars 104 are disposed at the other positions.

In the transfer belt having this configuration, the tension $T_1$ in the part corresponding to the fixed collars 103 is larger than the tension $T_2$ in the part corresponding to the free collars 104 ($T_1>T_2$). Accordingly, forces $F_{10}$ and $F_{11}$ causing the transfer belt 53 to move to the fixed collars 103 acts on the transfer belt 53.

Since the rotation velocity $v_1$ of the transfer belt 53 in the part corresponding to the fixed collars 103 is greater than the rotation velocity $v_2$ in the part corresponding to the free collars 104 ($v_1>v_2$), the transfer belt 53 is more stretched in the part corresponding to the fixed collars 103 than in the part corresponding to the free collars 104. Accordingly, as shown in FIG. 16B, the tension $T_R$ on the right side of the transfer belt 53 is greater than the tension $T_L$ on the left side ($T_R>T_L$). As a result, the force $F_1$ based on a torsion moment acts on the transfer belt 53 and thus the transfer belt 53 is inclined by a micro angle θ as shown in FIG. 18C. Thereafter, a difference between the direction in which the transfer belt 53 is wound and the rotation direction of the inertial roll 100 occurs due to the micro angle θ and the force F2 causing the transfer belt 53 to move to the right side in the drawing through the frictional force with the inertial roll 100 acts on the transfer belt 53, whereby the transfer belt 53 slowly moves to the right side.

In this way, according to this exemplary embodiment, the transfer belt 53 may easily move to the right side in the drawing so as to locate the fixed collars 103 substantially at the center in the belt width direction. Accordingly, this arrangement is particularly effective, for example, when the belt 53 tends to meander in a constant direction (easily meanders to the opposite side of the side on which the fixed collars 103 are arranged about the center). In this exemplary embodiment, a frictional-resistance layer may be formed on the peripheral surface of the fixed collar 103 and a lubricant layer may be formed on the peripheral surface of the free collar 104. The outer diameter of the fixed collar 103 may be set to be larger than the outer diameter of the free collar 104.

Fourth Exemplary Embodiment

Figure 19:
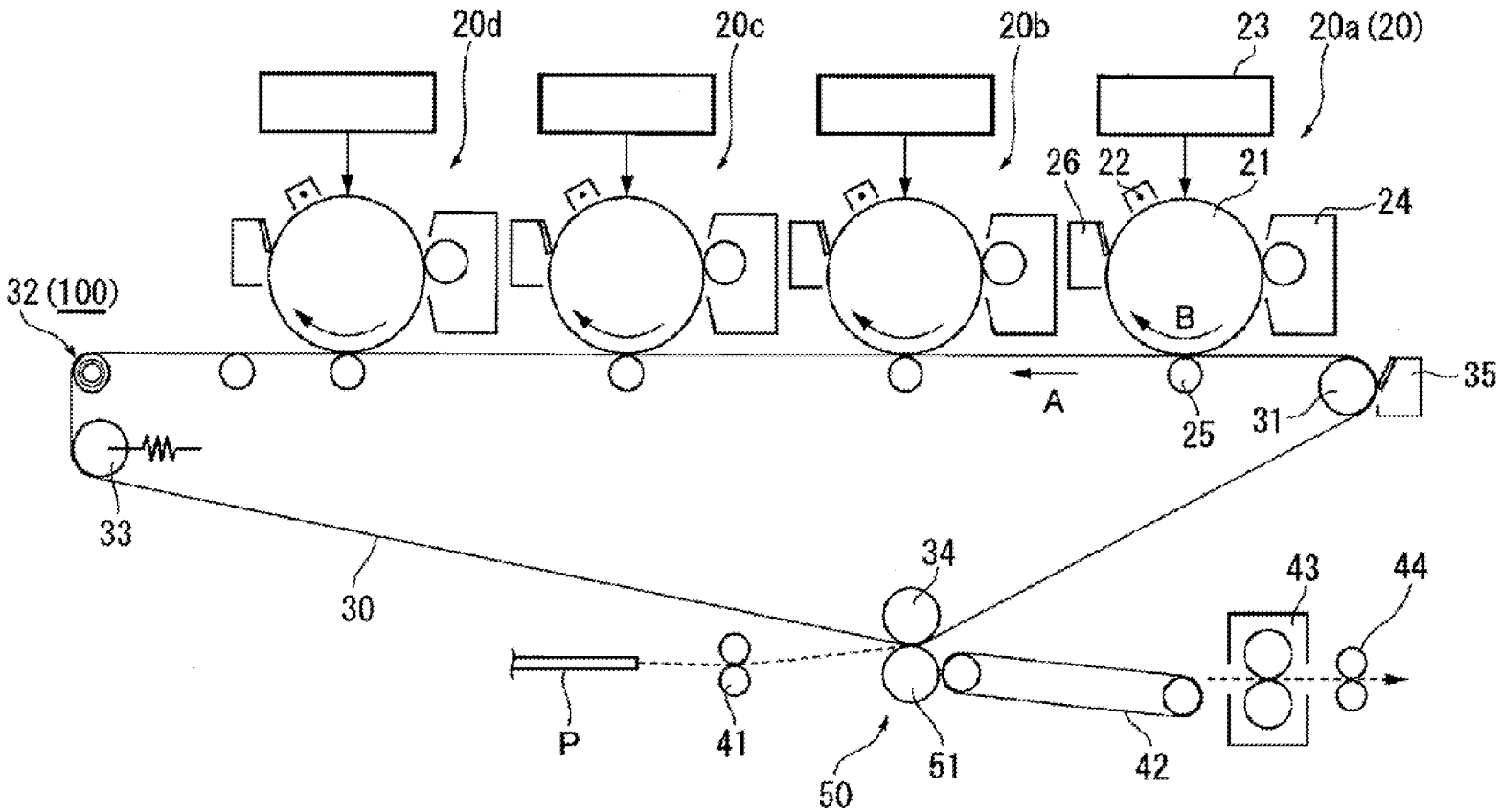
FIG. 19 is a diagram schematically illustrating an image forming apparatus according to a fourth exemplary embodiment of the invention.

FIG. 19 is a diagram schematically illustrating an image forming apparatus according to a fourth exemplary embodiment. The image forming apparatus according to this exemplary embodiment has substantially the same configuration as the image forming apparatus (see FIG. 3) according to the first exemplary embodiment, but is different from the image forming apparatus according to the first exemplary embodiment, in that the transfer device 50 includes only the transfer roll 51 and the support roll supporting the intermediate transfer belt 30 is constructed by the inertial roll 100. The same elements as in the first exemplary embodiment will be referenced by the same reference numerals and detailed description thereof will not be repeated.

Since the image forming apparatus according to this exemplary embodiment is substantially similar to the image forming apparatus according to the first exemplary embodiment, the configuration or operation thereof will not be described. Out of support rolls 31 to 34 of the intermediate transfer belt 30, the support roll 32 between the image forming unit 20*d* located on the most downstream side and the tension roll 33 is constructed by the inertial roll 100.

In the image forming apparatus having this configuration, when a recording medium P rushes into the secondary transfer part (the opposed, part between the transfer roll 51 and the intermediate transfer belt 30), a velocity variation in the intermediate transfer belt 30 may be caused. However, in this exemplary embodiment, even when a velocity variation in the intermediate transfer belt 30 is caused due to such an unexpected load variation, the velocity variation in the intermediate transfer belt 30 is suppressed by constructing the support roll 32 as the inertial roll 100. The meandering or the occurrence of a crease in the intermediate transfer belt 30 is also suppressed, thereby causing the intermediate transfer belt 30 to stably move.

In this exemplary embodiment, the tension roll 33 is provided, and a tension pressing the intermediate transfer belt 30 to the outside is applied to the tension roll 33 by an impelling mechanism (not shown). Accordingly, the vibration of the tension roll 33 may increase when the intermediate transfer belt 30 rotates. However, in this exemplary embodiment, the inertial roll 100 is disposed in the vicinity of the tension roll 33. Accordingly, even when the vibration is generated in the tension roll 33 at the time of applying the tension to the intermediate transfer belt 30, the unexpected load variation is absorbed, by the inertial roll 100. As a result, the velocity variation in the intermediate transfer belt 30 is not caused and an influence causing an image defect is not applied to the primary transfer part between the photoreceptor 21 and the intermediate transfer belt 30.

In this exemplary embodiment, the support roll 32 between the image forming unit 20*d* located on the upstream side from the tension roll 33 in the rotation direction of the intermediate transfer belt 30 and the tension roll 33 is constructed by the inertial roll 100, but a follower roll out of the other support rolls may be constructed by the inertial roll 100. For example, a support roll (follower roll) pressing the intermediate transfer belt 30 from the surface of the intermediate transfer belt 30 may be provided to a part not affecting a toner image on the intermediate transfer belt 30, for example, between the belt cleaner 35 and the image forming unit 20*a* and this support roll may be constructed by the inertial roll 100.

Fifth Exemplary Embodiment

Figure 20:
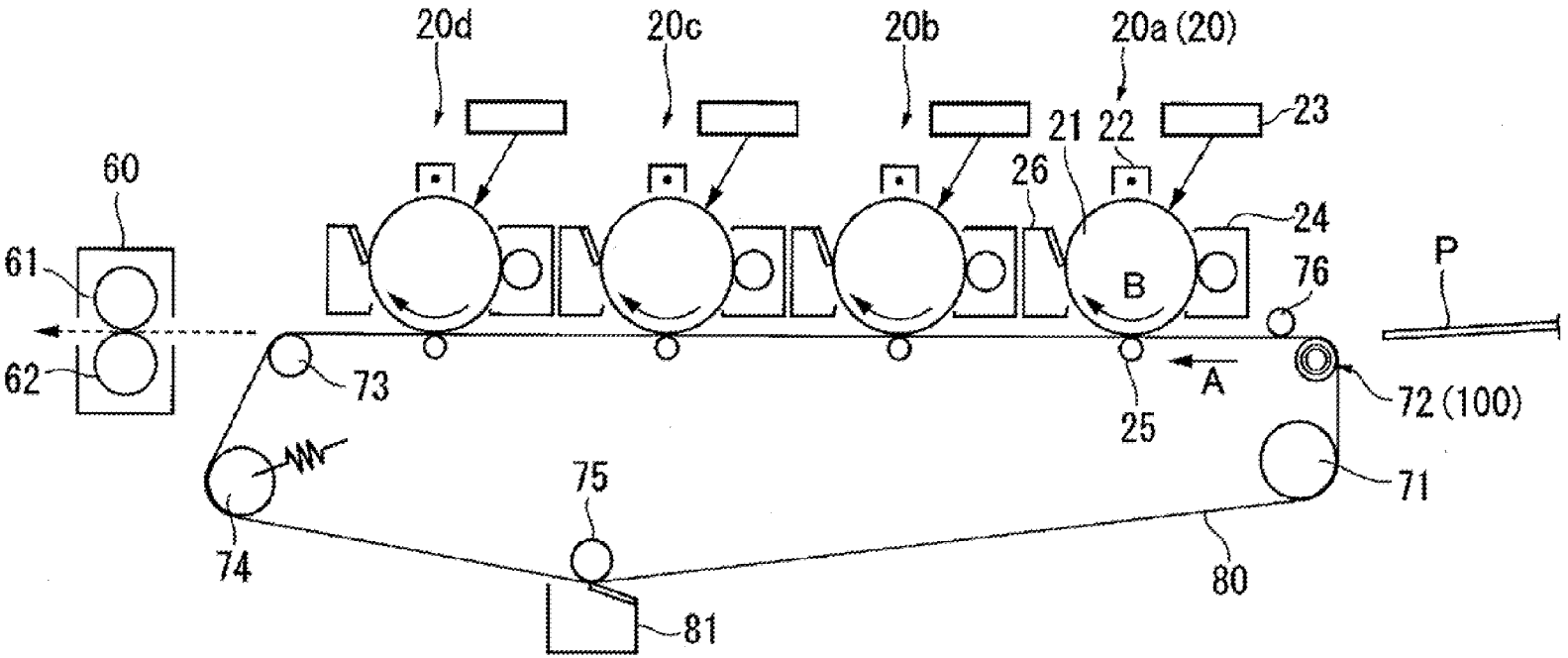
FIG. 20 is a diagram schematically illustrating an image forming apparatus according to a fifth exemplary embodiment of the invention.

FIG. 20 is a diagram schematically illustrating an image forming apparatus according to a fifth exemplary embodiment. The image forming apparatus according to this exemplary embodiment includes a recording medium transporting belt 80 transporting a recording medium P. Since the configuration of the image forming apparatus is similar to that in the first exemplary embodiment, the same elements as in the first exemplary embodiment will be referenced by the same reference numerals and detailed description thereof will not be repeated.

The image forming apparatus according to this exemplary embodiment includes four image forming units 20 (20*a* to 20*d*) as an image holding member having a toner image formed and held thereon, a transfer unit transferring the toner image held on the corresponding image forming unit 20 to a recording medium P, and a recording medium transporting unit transporting the recording medium P to the opposed part between the image forming unit 20 and the corresponding transfer unit. The recording medium transporting unit includes a recording medium transporting belt 80 as an endless belt member moving cyclically and holding and transporting the recording medium P. The inertial roll 100 is employed by the belt moving unit moving the recording medium transporting belt 80.

The recording medium transporting belt 80 is supported by plural support rolls 71 to 75 and rotates cyclically in the direction of arrow A. The support roll 71 is a driving roll moving the recording medium transporting belt 80, and the support roll 74 is a tension roll applying a tension to the recording medium transporting belt 80. A cleaner 81 cleaning the contamination on the recording medium transporting belt 80 is disposed at the position opposed to the support roll 75 between the tension roll 74 and the driving roll 71 with the recording medium transporting belt 80 interposed therebetween. A charging device 76 absorbing the recording medium P on the recording medium transporting belt 80 is disposed at the position between the image forming unit 20*a* and the support roll 72 on the surface side of the recording medium transporting belt 80, and the recording medium P is absorbed onto the recording medium transporting belt 80 charged by the charging device 76. Reference numeral 60 represents a fixing device including, for example, a heating roll 61 and a pressing roll 62.

In this exemplary embodiment, the support roll 72 adjacent to the driving roll 71 on the downstream side is constructed by the inertial roll 100. Since the inertial roll 100 in this exemplary embodiment has substantially the same configuration as in the first exemplary embodiment, details thereof will not be described.

The operation of the image forming apparatus according to this exemplary embodiment will be described below with reference to FIG. 20. A recording medium P transported from a recording medium supply section (not shown; is absorbed and held on the recording medium transporting belt 80 through the use of the charging device 76 of the recording medium transporting belt 80 and moves in synchronization with the movement of the recording medium transporting belt 80. The toner images formed by the image forming units 20 (20*a* to 20*d*) are sequentially transferred, to the recording medium P held on the recording medium transporting belt 80 in synchronisation with the movement of the recording medium transporting belt 80, and a multiplexed toner image is formed on the recording medium P when passing through the image forming unit 20*d* on the most downstream side. Thereafter, the recording medium P is separated from the recording medium transporting belt 80 and is transported to the fixing device 60, and the recording medium P having been subjected to the fixation is discharged from the apparatus. When a toner is attached to the recording medium transporting belt 80 in a state where a recording medium P is not present due to a jam or the lire, it is cleaned by the cleaner 81.

In this exemplary embodiment, the support roll 72 supporting the recording medium transporting belt 80 is constructed by the inertial roll 100. Even when an unexpected velocity variation of the recording medium transporting belt 80, for example, due to the vibration of the driving roll 71 is generated in the recording medium transporting belt 80, the velocity variation of the recording medium transporting belt 80 is suppressed by the inertial roll 100. Accordingly, the occurrence of an image defect in the transfer part of the primary transfer device 25 is suppressed. Even when the load variation occurs due to the inrush of the recording medium P into the transfer part, the velocity variation of the recording medium transporting belt 80 is suppressed. The meandering or the occurrence of a crease in the recording medium transporting belt 80 is suppressed by the inertial roll 100, thereby maintaining the stable movement.

Sixth Exemplary Embodiment

Figure 21A:
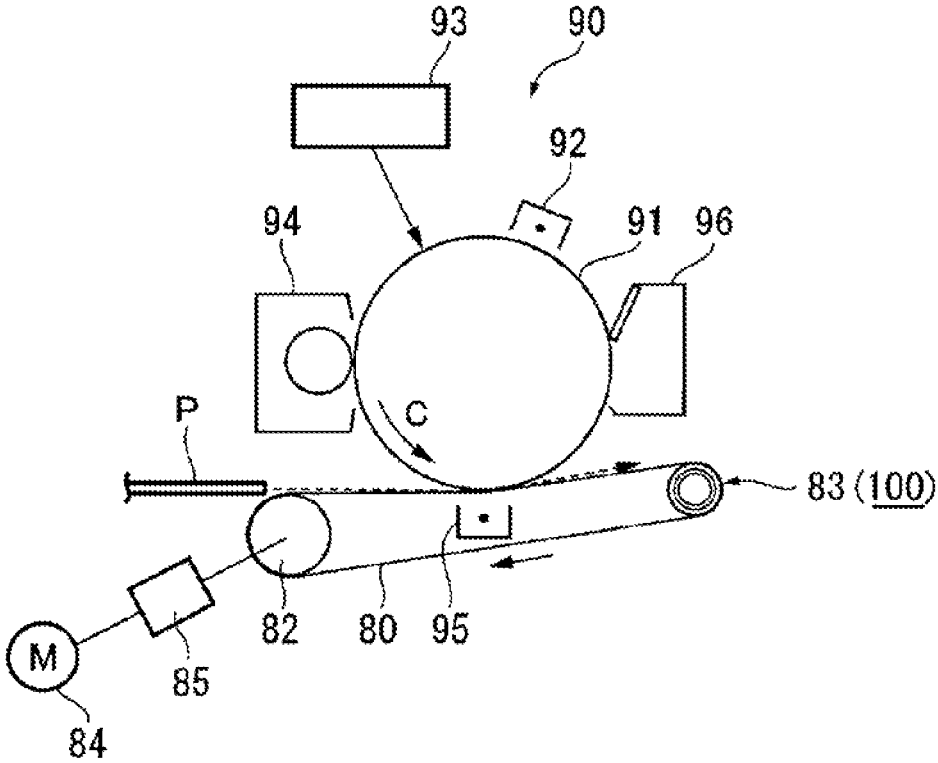
FIG. 21A is a diagram schematically illustrating an image forming apparatus according to a sixth exemplary embodiment of the invention and FIG. 21B is a diagram illustrating a modified example of FIG. 21A.

FIG. 21A is a diagram schematically illustrating an image forming apparatus according to a sixth exemplary embodiment. The image forming apparatus according to this exemplary embodiment includes an image forming unit 90 as an image forming and holding member and a recording medium transporting belt 80 at a position opposed to the image forming unit 90.

The image forming unit 90 includes a photoreceptor 91 rotating in the direction of arrow C in the drawing, and a charging device 92 charging the photoreceptor 91, an exposing device 93 exposing the charged photoreceptor 91 to form a latent image thereon, a developing device 94 developing the latent image formed on the photoreceptor 91, a transfer device 95 including a corona charger transferring the developed, toner image on the photoreceptor 91 to a recording medium P, and a cleaner 96 cleaning the remaining toner on the photoreceptor 91 after the transfer are arranged around the photoreceptor 91.

The recording medium transporting belt 80 is supported by two support rolls of a driving roll 82 and a follower roll 83, and the transfer device 95 is disposed inside the recording medium transporting belt 80. A motor 84 is installed in the driving roll 82 with a torque limiter 85 interposed therebetween and the driving power of the motor 84 is limited by the torque limiter 85. In this exemplary embodiment, the follower roll 83 supporting the recording medium transporting belt 80 is constructed by the inertial roll 100.

In this configuration, when a recording medium P rushes into the transfer part which is the opposed part between the photoreceptor 91 and the recording medium transporting belt 80, a variation in rotation velocity of the photoreceptor 91 may occur. However, since the follower roll 83 supporting the recording medium transporting belt 80 is constructed by the inertial roll 100, the velocity variation of the photoreceptor 91 is suppressed through the suppression of the velocity variation of the recording medium transporting belt 80 and thus the occurrence of an image defect is suppressed. As a result, the meandering and the occurrence of a crease in the recording medium transporting belt 80 are also suppressed.

The transfer device 95 in this configuration is not limited to the configuration shown in FIG. 21A, but may employ another configuration. For example, a roll member instead of the corona charger may be used as the transfer device 95.

Figure 21B:
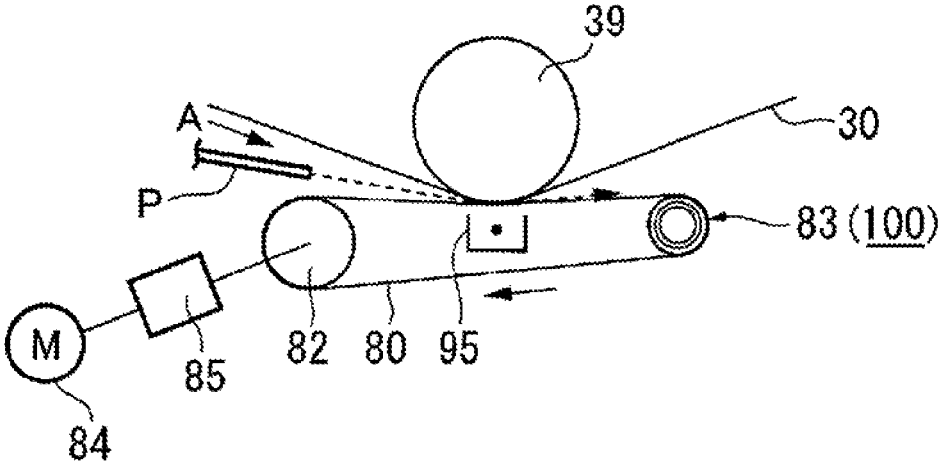

FIG. 21B shows a modified example of this exemplary embodiment, where the intermediate transfer belt 30 is applied to the image forming unit 90. In the drawing, the recording medium transporting belt 80 is supported by two support rolls of a driving roll 82 and a follower roll 83, and the driving roll 82 is driven by the motor 84 via the torque limiter 85. In order to transfer a toner image on the intermediate transfer belt 30 to a recording medium P, a transfer device 95 of a corona charge type is disposed on the rear side of the recording medium transporting belt 80 at the position of the intermediate transfer belt 30 opposed to the support roll 39.

In this configuration, since the transfer device 95 is separated from the recording medium transporting belt 80, a sufficient overlap part is secured between the intermediate transfer belt 30 and the recording medium transporting belt 80. The follower roll 83 supporting the recording medium transporting belt 80 is constructed by the inertial roll 100.

In this configuration, the sliding between the intermediate transfer belt 30 and the recording medium transporting belt 80 is suppressed and a stable rotation is achieved. For example, when a recording medium P rushes into the transfer part, an expected velocity variation in the intermediate transfer belt 30 occurs. However, since the follower roll 83 on the recording medium transporting belt 80 side is constructed by the inertial roll 100, the velocity variation of the recording medium transporting belt 80 is suppressed and thus the velocity variation of the intermediate transfer belt 30 is suppressed. The meandering or the occurrence of a crease in the recording medium, transporting belt 80 is suppressed.

In this modified example, the transfer device 95 employs a corona charge type, but, for example, a roll member may be used instead. Accordingly, the transfer device may be appropriately selected. In this modified example, the driving roll 82 is used, but a follower roll may be used instead of the driving roll 82. In this case, the overlap area of the intermediate transfer belt 30 and the recording medium transporting belt 80 is taken wide, thereby suppressing the sliding therebetween.

EXAMPLES

In this example, the velocity variation rate in the intermediate transfer belt in the primary transfer part when the conditions of the support roll are changed using the image forming apparatus according to the first exemplary embodiment is evaluated and confirmed.

The test conditions are as follows.

Support roll: three types to be described below (1) A follower roll supporting a transfer belt is constructed by an inertial roll (marked by FLYWHEEL IN FOLLOWER ROLL), (2) A flywheel is attached to a transfer roll (a flywheel is attached to a simple roll member without including a fixed collar or a free collar, marked by FLYWHEEL IN TRANSFER ROLL), and (3) A flywheel is removed from an inertial roll (marked by NO FLYWHEEL).

Transfer belt; an overcoat layer formed of an urethane resin in which carbon is dispersed is formed on the surface layer of a conductive chloroprene rubber, a thickness of about 0.45 mm, a JIS hardness of about 80 degrees Rotation shaft of inertial roll: stainless alloy, an outer diameter of 10 mm.

Fixed collar of inertial roll: formed of resin (POM), an outer diameter of 15 mm, an inner diameter of less than 10 mm, press-fitted to the rotation shaft, a roughened surface Free collar of inertial roll: formed of resin (POM), a gap from the rotation shaft in the vicinity of an outer diameter of 15 mm and an inner diameter of 10 mm, surface coated with a lubricant layer formed of fluorine resin, maximum gap in the axis direction of 0.4 mm Flywheel of inertial roll: formed of stainless alloy, a disk shape with an outer diameter of 150 mm and a thickness of 4 mm Transfer roll: epichlorohydrin rubber layer on a metal surface, an outer diameter of 28 mm, not including a driving source, rotating along with an intermediate transfer belt Regarding the evaluation, the velocity variation rate in the intermediate transfer belt is measured when a recording medium rushes into the secondary transfer part in three types of support rolls are mounted.

Figure 22:
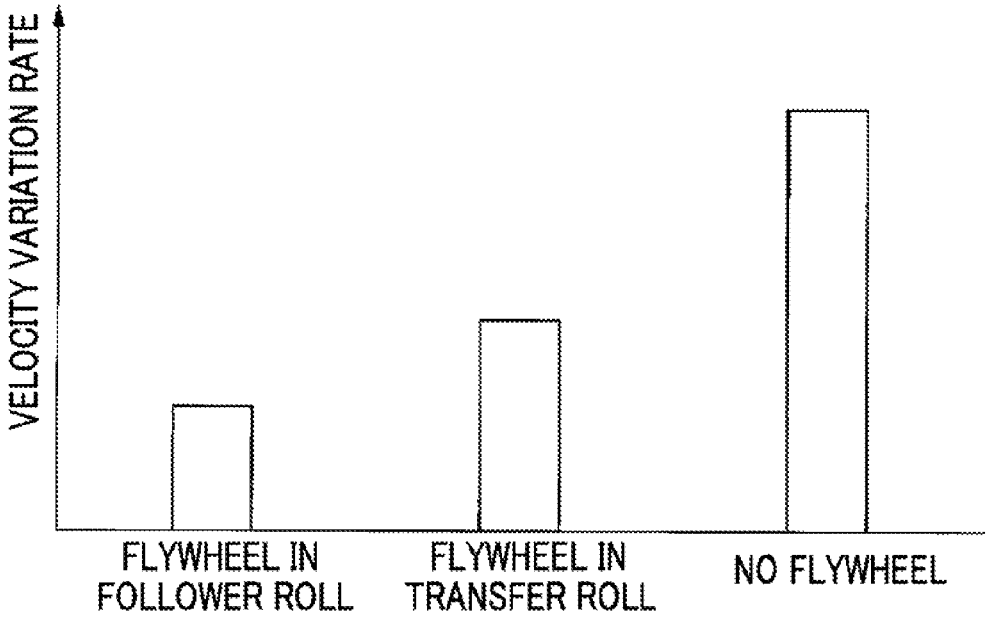
FIG. 22 is a diagram illustrating the results of examples.

As shown in the results of FIG. 22, it is proved that the "FLYWHEEL IN FOLLOWER ROLL" more greatly decreases in velocity variation rate than "FLYWHEEL IN TRANSFER ROLL" and "FLYWHEEL IN TRANSFER ROLL" more greatly decreases in velocity variation rate than "NO FLYWHEEL". The reason is thought as follows.

In "FLYWHEEL IN TRANSFER ROLL", since the outer diameter of the transfer roll is larger than the outer diameter of the follower roll (inertial roll), the effect of the inertial force of the flywheel is smaller than that in "FLYWHEEL IN FOLLOWER ROLL". In "NO FLYWHEEL", the effect on the velocity variation is hardly observed and thus if may be understood that the transmission of the inertial force of the flywheel to the intermediate transfer belt is important in suppressing the velocity variation in the intermediate transfer belt.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A belt moving unit comprising:

an endless belt member; and a plurality of support rolls that support the belt member movably and that is rotatable, wherein the plurality of support rolls include one or more follower rolls that rotates to follow the movement of the belt member and at least one of the follower rolls is used as an inertial roll to which inertia is applied in a direction in which an amount of inertia increases, wherein the inertial roll includes a rotation shaft that is rotatable, a rotational inertial member that rotates with the rotation shaft and that applies inertia in a direction in which the amount of inertia of the rotation shaft increases, and a roll body that is disposed along a peripheral surface of the rotation shaft and that includes a plurality of roll-divided members formed by dividing the roll body into a plurality of parts in an axis direction of the rotation shaft, and wherein the plurality of roll-divided members include a fixed divided member that is fixed to the rotation shaft and that rotates along with the rotation shaft to follow the movement of the belt member, and a rotating divided member that is rotatable independently of the rotation of the rotation shaft.

2. The belt moving unit according to claim 1, wherein the rotating divided member is inserted into the rotation shaft with a predetermined gap therebetween.

3. The belt moving unit according to claim 2, wherein the fixed divided member is fixed to the rotation shaft by press-fitting.

4. The belt moving unit according to claim 2, wherein the fixed divided member is fixed to the rotation shaft by adhesion.

5. The belt moving unit according to claim 2, wherein one part of the rotation shaft has a large-diameter portion having an outer diameter larger than that of another part, and wherein the fixed divided member is formed by the large-diameter portion of the rotation shaft.

6. The belt moving unit according to claim 1, wherein the fixed divided member is fixed to the rotation shaft by press-fitting.

7. The belt moving unit according to claim 1, wherein the fixed divided member is fixed to the rotation shaft by adhesion.

8. The belt moving unit according to claim 1, wherein one part of the rotation shaft has a large-diameter portion having an outer diameter larger than that of another part, and wherein the fixed divided member is formed by the large-diameter portion of the rotation shaft.

9. The belt moving unit according to claim 1, wherein one of the fixed divided member and the rotation shaft has a convex portion protruding in the diameter direction of the rotation shaft, the other thereof has a concave portion which is recessed in the diameter direction of the rotation shaft and into which the convex portion is fitted, and the fixed divided member is stopped and fixed in the rotating direction of the rotation shaft by fitting the concave portion and the convex portion with each other when fitting the fixed divided member to the rotation shaft.

10. The belt moving unit according to claim 9, wherein the concave portion and the convex portion are configured so that the convex portion is fitted into the concave portion with a predetermined gap in the rotating direction of the rotation shaft.

11. The belt moving unit according to claim 1, wherein the outer diameter of the fixed divided member is set to be larger than the outer diameter of the rotating divided member.

12. The belt moving unit according to claim 1, wherein the rotating divided member is disposed with a predetermined gap from the fixed divided member or the rotating divided member adjacent in the axis direction of the rotation shaft and is movable along the axis direction thereof.

13. The belt moving unit according to claim 1, wherein the rotating divided member is disposed on both sides of the central portion of the rotation shaft with the fixed divided member interposed therebetween in the axis direction of the rotation shaft.

14. The belt moving unit according to claim 13, wherein the fixed divided member and the rotating divided member are arranged substantially symmetrically about the central portion of the rotation shaft.

15. The belt moving unit according to claim 1, wherein the fixed divided member is disposed on both sides of the central portion of the rotation shaft with the rotating divided member interposed therebetween in the axis direction of the rotation shaft.

16. The belt moving unit according to claim 1, wherein the fixed divided member further comprises:

a frictional-resistance layer increasing the frictional resistance about the belt member on the peripheral surface thereof.

17. An image forming apparatus comprising:

an image holding member that holds a toner image; and a transfer unit that transfers the toner image held on the image holding member to a recording medium, wherein at least one of the image holding member and the transfer unit includes an endless belt member that is movable cyclically, and wherein the belt moving unit according to claim 1 is used as a belt moving unit moving the belt member.

18. The image forming apparatus according to claim 17, wherein the transfer unit comprises:

a roll-like transfer member that is disposed to face the image holding member and that transfers the toner image on the image holding member to the recording medium; and a transfer belt as an endless belt member that is supported by a plurality of support rolls including the transfer member, that cyclically moves, and that transports the recording medium along a linear path extending from a transfer position between the image holding member and the transfer member, and wherein the belt moving unit moves the transfer belt.

19. The image forming apparatus according to claim 17, wherein the image holding member comprises:

an image forming and holding member that forms and holds the toner image; and an intermediate transfer belt as an endless belt member that is disposed to face the image forming and holding member and that temporarily holds the toner image on the image forming and holding member before transferring the toner image to the recording medium, and wherein the belt moving unit moves the intermediate transfer belt.

20. An image forming apparatus comprising:

an image holding member that holds a toner image;

a transfer unit that transfers the toner image held on the image holding member to a recording medium; and a recording medium transport unit that transports the recording medium to an opposed position between the image holding member and the transfer unit, wherein the recording medium transport unit includes a recording medium transport belt as an endless belt member that holds and transports the recording medium, and wherein the belt moving unit according to claim 1 is used as a belt moving unit moving the recording medium transport belt.

* * * * *